US009988733B2

(12) United States Patent
Graham et al.

(10) Patent No.: US 9,988,733 B2
(45) Date of Patent: Jun. 5, 2018

(54) APPARATUS AND METHOD FOR MODULATING AZIMUTHAL UNIFORMITY IN ELECTROPLATING

(71) Applicant: Lam Research Corporation, Fremont, CA (US)

(72) Inventors: Gabriel Hay Graham, Portland, OR (US); Lee Peng Chua, Beaverton, OR (US); Steven T. Mayer, Aurora, OR (US); Robert Rash, West Linn, OR (US); Aaron Berke, Portland, OR (US)

(73) Assignee: Lam Research Corporation, Fremont, CA (US)

( * ) Notice: Subject to any disclaimer, the term of this patent is extended or adjusted under 35 U.S.C. 154(b) by 311 days.

(21) Appl. No.: 14/734,882

(22) Filed: Jun. 9, 2015

(65) Prior Publication Data

US 2016/0362809 A1 Dec. 15, 2016

(51) Int. Cl.
*C25D 17/00* (2006.01)

(52) U.S. Cl.
CPC ..... *C25D 17/001* (2013.01); *C25D 17/008* (2013.01)

(58) Field of Classification Search
CPC ..... C25D 17/001; C25D 17/008
See application file for complete search history.

(56) References Cited

U.S. PATENT DOCUMENTS 3,880,725 A 4/1975 Van Raalte et al.
4,304,641 A 12/1981 Grandia et al.
4,696,729 A 9/1987 Santini
(Continued)

FOREIGN PATENT DOCUMENTS

CA 1 236 627 7/1986
CN 1531028 A 9/2004
(Continued)

OTHER PUBLICATIONS

U.S. Appl. No. 14/578,068, filed Dec. 19, 2014, entitled "Methods and Apparatuses for Dynamically Tunable Wafer-Edge Electroplating."

(Continued)

*Primary Examiner* — Ciel P Thomas

(74) *Attorney, Agent, or Firm* — Weaver Austin Villeneuve & Sampson LLP

(57) ABSTRACT

An apparatus for electroplating metal on a semiconductor substrate with improved azimuthal uniformity includes in one aspect: a plating chamber configured to contain an electrolyte and an anode; a substrate holder configured to hold the semiconductor substrate; an ionically resistive ionically permeable element ("the element") configured to be positioned proximate the substrate; and a shield configured for providing azimuthally asymmetrical shielding and positioned between the substrate holder and the element such that the closest distance between the substrate-facing surface of the shield and the working surface of the substrate is less than 2 mm. In some embodiments there is an electrolyte-filled gap between the substrate-facing surface of the element and the shield during electroplating. The substrate-facing surface of the shield may be contoured such that the distance from different positions of the shield to the substrate is varied.

11 Claims, 25 Drawing Sheets

(56) References Cited

U.S. PATENT DOCUMENTS

| | | | |
|---|---|---|---|
| 5,078,852 | A | 1/1992 | Yee et al. |
| 5,169,684 | A | 12/1992 | Takagi |
| 5,312,352 | A | 5/1994 | Leschinsky et al. |
| 5,312,532 | A | 5/1994 | Andricacos et al. |
| 5,620,581 | A | 4/1997 | Ang |
| 5,723,028 | A | 3/1998 | Poris |
| 5,774,019 | A | 6/1998 | Koyama et al. |
| 6,004,440 | A | 12/1999 | Hanson et al. |
| 6,027,631 | A | 2/2000 | Broadbent |
| 6,071,388 | A | 6/2000 | Uzoh |
| 6,074,544 | A | 6/2000 | Reid et al. |
| 6,099,702 | A | 8/2000 | Reid et al. |
| 6,106,687 | A | 8/2000 | Edelstein |
| 6,110,346 | A | 8/2000 | Reid et al. |
| 6,126,798 | A | 10/2000 | Reid et al. |
| 6,132,587 | A | 10/2000 | Jorne et al. |
| 6,132,805 | A | 10/2000 | Moslehi |
| 6,156,167 | A | 12/2000 | Patton et al. |
| 6,162,344 | A | 12/2000 | Reid et al. |
| 6,168,693 | B1 | 1/2001 | Uzoh et al. |
| 6,174,425 | B1 | 1/2001 | Simpson et al. |
| 6,179,983 | B1 | 1/2001 | Reid et al. |
| 6,193,860 | B1 | 2/2001 | Weling |
| 6,228,231 | B1 | 5/2001 | Uzoh |
| 6,261,433 | B1 | 7/2001 | Landau |
| 6,322,674 | B1 | 11/2001 | Berner et al. |
| 6,391,166 | B1 | 5/2002 | Wang |
| 6,402,923 | B1 | 6/2002 | Mayer et al. |
| 6,497,801 | B1 | 12/2002 | Woodruff et al. |
| 6,551,483 | B1 | 4/2003 | Mayer et al. |
| 6,569,299 | B1 | 5/2003 | Reid et al. |
| 6,599,412 | B1 | 7/2003 | Graham et al. |
| 6,627,051 | B2 | 9/2003 | Berner et al. |
| 6,632,335 | B2 | 10/2003 | Kunisawa et al. |
| 6,716,334 | B1 | 4/2004 | Reid et al. |
| 6,755,954 | B2 | 6/2004 | Mayer et al. |
| 6,773,571 | B1 | 8/2004 | Mayer et al. |
| 6,800,187 | B1 | 10/2004 | Reid et al. |
| 6,843,894 | B2 | 1/2005 | Berner et al. |
| 6,919,010 | B1 | 7/2005 | Mayer et al. |
| 7,323,094 | B2 | 1/2008 | Simpson et al. |
| 7,383,521 | B2 | 6/2008 | Smith et al. |
| 7,622,024 | B1 | 11/2009 | Mayer et al. |
| 7,682,498 | B1 | 3/2010 | Mayer et al. |
| 7,837,841 | B2 | 11/2010 | Chen et al. |
| 7,854,828 | B2 | 12/2010 | Reid et al. |
| 7,967,969 | B2 | 6/2011 | Mayer et al. |
| 8,308,931 | B2 | 11/2012 | Reid et al. |
| 8,475,636 | B2 | 7/2013 | Mayer et al. |
| 8,475,637 | B2 | 7/2013 | Mayer et al. |
| 8,475,644 | B2 | 7/2013 | Mayer et al. |
| 8,858,774 | B2 | 10/2014 | Mayer et al. |
| 9,260,793 | B2 | 2/2016 | Mayer et al. |
| 2002/0017456 | A1 | 2/2002 | Graham et al. |
| 2002/0020627 | A1 | 2/2002 | Kunisawa et al. |
| 2002/0119671 | A1 | 8/2002 | Lee |
| 2002/0125141 | A1 | 9/2002 | Wilson et al. |
| 2003/0038035 | A1 | 2/2003 | Wilson et al. |
| 2003/0079995 | A1 | 5/2003 | Contolini et al. |
| 2003/0201166 | A1 | 10/2003 | Zheng et al. |
| 2004/0149584 | A1 | 8/2004 | Nagai et al. |
| 2005/0145499 | A1 | 7/2005 | Kovarsky et al. |
| 2005/0164498 | A1 | 7/2005 | Ide et al. |
| 2006/0243598 | A1 | 11/2006 | Singh et al. |
| 2007/0029193 | A1 | 2/2007 | Brcka |
| 2010/0032303 | A1 | 2/2010 | Reid et al. |
| 2010/0032304 | A1 | 2/2010 | Mayer et al. |
| 2010/0032310 | A1 | 2/2010 | Reid et al. |
| 2010/0044236 | A1 | 2/2010 | Mayer et al. |
| 2010/0116672 | A1 | 5/2010 | Mayer et al. |
| 2012/0000786 | A1 | 1/2012 | Mayer et al. |
| 2012/0258408 | A1 | 10/2012 | Mayer et al. |
| 2013/0137242 | A1 | 5/2013 | He et al. |
| 2013/0313123 | A1* | 11/2013 | Abraham ..... C25D 5/08 205/143 |
| 2013/0327650 | A1 | 12/2013 | Mayer et al. |
| 2014/0144781 | A1 | 5/2014 | He |
| 2015/0060291 | A1 | 3/2015 | Mayer et al. |
| 2016/0115611 | A1 | 4/2016 | Mayer et al. |
| 2016/0177466 | A1 | 6/2016 | Kagajwala et al. |
| 2016/0215408 | A1 | 7/2016 | Kagajwala et al. |
| 2016/0222535 | A1* | 8/2016 | Zhou ..... C25D 5/08 |

FOREIGN PATENT DOCUMENTS

| | | | |
|---|---|---|---|
| CN | 1624207 | A | 6/2005 |
| CN | 1705774 | A | 12/2005 |
| CN | 101056718 | A | 10/2007 |
| CN | 101736376 | A | 6/2010 |
| CN | 102732924 | A | 10/2012 |
| EP | 1 179 617 | A1 | 2/2002 |
| JP | 2003-268591 | | 9/2003 |
| KR | 10-0707121 | | 4/2007 |
| WO | WO 99/14401 | | 3/1999 |
| WO | WO 99/64647 | | 12/1999 |
| WO | WO2010/144330 | | 12/2010 |

OTHER PUBLICATIONS

U.S. Appl. No. 14/602,910, filed Jan. 22, 2015, entitled "Apparatus and Method for Dynamic Control of Plated Uniformity With the Use of Remote Electric Current."

U.S. Final Office Action, dated Feb. 27, 2012, issued in U.S. Appl. No. 12/291,356.

U.S. Notice of Allowance, dated Jul. 27, 2012, issued in U.S. Appl. No. 12/291,356.

U.S. Office Action, dated Jun. 24, 2011, issued in U.S. Appl. No. 12/481,503.

U.S. Final Office Action, dated Mar. 1, 2012, issued in U.S. Appl. No. 12/481,503.

U.S. Office Action, dated Jul. 9, 2012, issued in U.S. Appl. No. 12/481,503.

U.S. Final Office Action dated Dec. 19, 2012, issued in U.S. Appl. No. 12/481,503.

U.S. Notice of Allowance dated Mar. 1, 2013 issued in U.S. Appl. No. 12/481,503.

U.S. Office Action, dated Jun. 24, 2011, issued in U.S. Appl. No. 12/606,030.

U.S. Final Office Action, dated Mar. 1, 2012, issued in U.S. Appl. No. 12/606,030.

U.S. Office Action, dated Jun. 28, 2012, issued in U.S. Appl. No. 12/606,030.

U.S. Office Action, dated Jul. 13, 2012, issued in U.S. Appl. No. 12/606,030.

U.S. Final Office Action, dated Dec. 17, 2012, issued in U.S. Appl. No. 12/606,030, U.S. Notice of Allowance dated Mar. 1, 2013 issued in U.S. Appl. No. 12/606,030.

U.S. Office Action, dated Feb. 25, 2014, issued in U.S. Appl. No. 13/438,443.

U.S. Notice of Allowance, dated Jun. 11, 2014, issued in U.S. Appl. No. 13/438,443.

Chinese First Office Action dated May 15, 2013 issued in CN Application No. 200910209697.2.

Chinese Second Office Action dated Dec. 10, 2013 issued in CN Application No. 200910209697.2.

PCT International Search Report and Written Opinion, dated Jan. 12, 2011, issued in PCT/US2010/037520.

PCT International Preliminary Report on Patentability and Written Opinion, dated Dec. 22, 2011, issued in PCT/US2010/037520.

Chinese First Office Action dated Nov. 6, 2013 issued in CN Application No. 201080032109.3.

Chinese Second Office Action dated Jun. 10, 2014 issued in CN Application No. 201080032109.3.

Taiwan Office Action dated Jul. 31, 2014 issued in TW Application No. 099118603.

U.S. Office Action, dated May 26, 2010, issued in U.S. Appl. No. 11/506,054.

(56) References Cited

OTHER PUBLICATIONS

U.S. Notice of Allowance, dated Aug. 13, 2010, issued in U.S. Appl. No. 11/506,054.
U.S. Office Action, dated Sep. 19, 2011, issued in U.S. Appl. No. 12/291,356.
U.S. Notice of Allowance, dated Oct. 2, 2015, issued in U.S. Appl. No. 14/483,942.
U.S. Notice of Allowance [Corrected Notice of Allowability], dated Nov. 10, 2015, issued in U.S. Appl. No. 14/483,942.
U.S. Notice of Allowance [Corrected Notice of Allowability], dated Jan. 20, 2016, issued in U.S. Appl. No. 14/483,942.
Chinese First Office Action dated Oct. 13, 2015 issued in CN 201210098129.1.
Chinese Second Office Action dated Jun. 6, 2016 issued in CN 201210098129.1.
Chinese Third Office Action dated Nov. 18, 2016 issued in CN 201210098129.1.
Taiwan Office Action dated Nov. 10, 2015 issued in TW Application No. 101111926.
Chinese Fourth Office Action dated May 31, 2017 issued in CN 201210098129.1.
Chinese First Office Action dated Mar. 31, 2017 issued in Application No. CN 201510556374.6.
Chinese First Office Action dated Nov. 3, 2017 issued in Application No. CN 201610394032.3.
Chinese Second Office Action dated Nov. 23, 2017 issued in Application No. CN 201510556374.6.
U.S. Notice of Allowance dated Mar. 14, 2018 issued in U.S. Appl. No. 14/987,170.
Korean First Office Action dated Apr. 10, 2018 issued in Application No. KR 10-2012-0035111.

* cited by examiner (a) (b)

(a) (c)

(a) (d)

APPARATUS AND METHOD FOR MODULATING AZIMUTHAL UNIFORMITY IN ELECTROPLATING

FIELD OF THE INVENTION

The present disclosure relates generally to a method and apparatus for electroplating a metal layer on a semiconductor wafer. More particularly, the method and apparatus described herein are useful for controlling azimuthal plating uniformity.

BACKGROUND

In semiconductor device manufacturing, a conductive material, such as copper, is often deposited by electroplating onto a seed layer of metal to fill one or more recessed features on a semiconductor wafer substrate. Electroplating is a method of choice for depositing metal into the vias and trenches of the wafer during damascene processing, and is also used in wafer level packaging (WLP) applications to form pillars and lines of metal on the wafer substrate. Another application of electroplating is filling of Through-Silicon Vias (TSVs), which are relatively large vertical electrical connections used in 3D integrated circuits and 3D packages.

In some electroplating substrates, the seed layer is exposed over the entire surface of the substrate prior to electroplating (typically in damascene and TSV processing), and electrodeposition of metal occurs over the entirety of the substrate. In other electroplating substrates, a portion of the seed layer is covered by a non-conducting material, such as by photoresist, while another portion of the seed layer is exposed. In such substrates with partially masked seed layer electroplating occurs only over the exposed portions of the seed layer, while the covered portions of the seed layer are protected from being plated upon. Electroplating on a substrate having a seed layer that is coated with patterned photoresist is referred to as through resist plating and is typically used in WLP applications.

During electroplating, electrical contacts are made to the seed layer (e.g., a copper seed layer) at the periphery of the wafer, and the wafer is electrically biased to serve as a cathode. The wafer is brought into contact with an electrolyte, which contains ions of metal to be plated. The electrolyte typically also includes an acid that provides sufficient conductivity to the electrolyte and may also contain additives, known as accelerators, suppressors, and levelers that modulate electrodeposition rates on different surfaces of the substrate.

One of the problems encountered during electroplating is non-uniform distribution of thickness of electrodeposited metal along the radius of the circular semiconductor wafer. This type of non-uniformity is known as radial non-uniformity. Radial non-uniformity may occur due to a variety of factors, such as due to a terminal effect, and due to variations in electrolyte flow at the surface of the substrate. Terminal effect manifests itself in edge-thick electroplating, because the potential in the vicinity of the electrical contacts at the edge of the wafer can be significantly higher than at the center of the wafer, particularly if a thin resistive seed layer is used.

Another type of non-uniformity, which can be encountered during electroplating, is azimuthal non-uniformity. For clarity, we define azimuthal non-uniformity, using polar coordinates, as thickness variations exhibited at different angular positions on the wafer at a fixed radial position from the wafer center, that is, a non-uniformity along a given circle or portion of a circle within the perimeter of the wafer. This type of non-uniformity can be present in electroplating applications, independently of radial non-uniformity, and in some applications may be the predominant type of non-uniformity that needs to be controlled. It often arises in through resist plating, where a major portion of the wafer is masked with a photoresist coating or with a similar plating-preventing layer, and the masked pattern of features or feature densities are not azimuthally uniform near the wafer edge. For example, in some cases there may be a technically required chord region of missing pattern features near the notch of the wafer to allow for wafer numbering or handling.

Excessive radial and azimuthal non-uniformity can lead to non-functional chips. Therefore methods and apparatus for improving plating uniformity are needed.

SUMMARY OF THE INVENTION

Described are method and apparatus for electroplating metal on a substrate with improved azimuthal plating uniformity. Apparatus and methods described herein can be used for electroplating on a variety of substrates, and are particularly useful for plating on azimuthally non-uniform substrates, such as on substrates that have an azimuthally non-uniform missing die region. The apparatus and methods make use of an ionically resistive ionically permeable element ("the element") in combination with an azimuthally asymmetric shield, where the element and the shield are used in configurations that improve uniformity of plating.

In one aspect, an electroplating apparatus is provided. The electroplating apparatus includes: (a) a plating chamber configured to contain an electrolyte and an anode while electroplating metal onto a semiconductor substrate; (b) a substrate holder configured to hold and rotate the semiconductor substrate during electroplating; (c) an ionically resistive ionically permeable element comprising a substrate-facing surface and an opposing surface, wherein the element allows for flow of ionic current through the element towards the substrate during electroplating, wherein the ionically resistive ionically permeable element comprises a plurality of non-communicating channels, and wherein the ionically resistive ionically permeable element is positioned such that a closest distance between the substrate-facing surface of the element and a working surface of the substrate is about 10 mm or less; and (d) a shield, configured for providing azimuthally asymmetric shielding, wherein the shield has a substrate-facing surface and an opposing surface, wherein the shield is positioned such that the closest distance between the substrate-facing surface of the shield and the working surface of the substrate is less than about 2 mm. Preferably, the closest distance between the substrate-facing surface of the shield and the working surface of the substrate is about 0.5 mm-1.5 mm.

In some embodiments the substrate-facing surface of the shield is contoured such that a distance from the substrate-facing surface of the shield to the working surface of the substrate is varied (e.g., either gradually or in discrete steps). In some embodiments, the substrate-facing surface of the shield is contoured such that a distance from the substrate-facing surface of the shield to the working surface of the substrate is varied radially for a selected azimuthal position. For example, in one implementation, the substrate-facing surface of the shield is contoured such that a distance from the substrate-facing surface of the shield to the working surface of the substrate at a first radial position is greater than at a second radial position, wherein the second radial position is greater than the first radial position. Radial position is measured from the radial position corresponding to the center of the substrate (zero radial position) such that it increases in an outward direction towards the radial position of the edge of the substrate. In some implementations, the substrate-facing surface of the shield is contoured such that a distance from the substrate-facing surface of the shield to the working surface of the substrate gradually decreases in a radial direction as the radial position increases at least for a portion of the shield.

In some embodiments, the opposite surface of the shield contacts the ionically resistive ionically permeable element and blocks a portion of the channels on the substrate-facing surface of the element.

The shield may be generally solid (without any openings) or, in some embodiments, may contain one or more electrolyte-permeable openings allowing for ionic current to pass through the openings.

In some implementations the shield is generally wedge-shaped. One example of a suitable shield is a shield that has a central wedge angle of between about 100-180°, located at a radial distance of between about 10-40 mm from a radial position of an edge of the substrate.

In many embodiments the ionically resistive ionically permeable element is positioned such that the distance between the substrate-facing surface of the element and the substrate is between about 2-10 mm during electroplating, and the shield is positioned such that the smallest distance between the substrate-facing surface of the shield and the working surface of the substrate is about 1.5 mm or less during electroplating.

In some implementations the shield is positioned such that there is an electrolyte-filled gap between the substrate-facing surface of the ionically resistive ionically permeable element and the shield during electroplating. When this configuration is used, it is preferable to configure the apparatus such that at least a portion of the non-communicating channels of the element falling into a projection of the shield is blocked to ionic current flow. This can be accomplished, for example, by providing a second shield contacting the opposing surface of the ionically resistive ionically permeable element, where the second shield serves to block at least a portion of the non-communicating channels falling into a projection of the shield. In another configuration, a specially designed element is provided, wherein at least a portion of the element falling into a projection of the shield has no channels. Further, when there is a gap between the element and the top shield, in some embodiments the apparatus further comprises an inlet to a microchamber between the substrate and the ionically resistive ionically permeable element for introducing electrolyte flowing to the microchamber and an outlet to the microchamber for receiving electrolyte flowing through the microchamber, wherein the inlet and the outlet are positioned proximate azimuthally opposing perimeter locations of the working face of the substrate, and wherein the inlet and outlet are adapted to generate cross-flow of electrolyte in the microchamber. For example, the apparatus may be configured for generating electrolyte cross-flow through the gap between the ionically resistive ionically permeable element and the shield. In some embodiments the outlet to the microchamber is located at the periphery of the top shield. In some embodiments, the gap between the ionically resistive ionically permeable element and the shield is between about 0.5-5 mm.

In another aspect a method of electroplating a metal on a substrate while controlling azimuthal uniformity is provided. In one embodiment the method includes: (a) providing the substrate into an electroplating apparatus configured for rotating the substrate during electroplating, wherein the electroplating apparatus comprises: (i) an ionically resistive ionically permeable element comprising a substrate-facing surface and an opposing surface, wherein the element allows for flow of ionic current through the element towards the substrate during electroplating, wherein the ionically resistive ionically permeable element comprises a plurality of non-communicating channels and wherein the ionically resistive ionically permeable element is positioned such that a closest distance between the substrate-facing surface of the element and a working surface of the substrate is about 10 mm or less; and (ii) a shield, configured for providing azimuthally asymmetric shielding, wherein the shield is positioned such that the closest distance between the substrate-facing surface of the shield and the working surface of the substrate is less than about 2 mm; and (b) electroplating the metal on the substrate while rotating the substrate relative to a shield such that a selected portion of the substrate at a selected azimuthal position dwells in a shielded area for a different amount of time than a second portion of the substrate having the same average arc length and the same average radial position and residing at a different angular azimuthal position. In some embodiments, electroplating includes rotating the substrate at a first speed when the selected portion of the substrate is less shielded, and at a second speed when the selected portion of the substrate is more shielded, wherein one full rotation of the substrate comprises a first period of rotation at the first speed and a second period of rotation at the second speed. In some embodiments, the substrate may slow down over a more shielded area two or more times per one full rotation of the substrate, such that two separate azimuthal portions on the wafer could dwell longer in the shielded area than analogous azimuthal portions (portions having the same average arc length and the same average radial position and residing at a different angular azimuthal position). In some embodiments two or more top azimuthally asymmetric shields can be used.

In some embodiments, more than two speeds may be employed. For example, one full rotation of the substrate may include rotation at a first speed, followed by slowing down to a second speed; rotation at a second speed followed by speeding up to a third speed; rotation at a third speed, followed by slow down to a fourth speed; rotation at a fourth speed, followed by speeding up to a first speed, wherein the first and third speed may be the same or different, and wherein the second and fourth speed may be the same or different. The periods of acceleration and deceleration may be very quick or, in some embodiments, relatively long. The dwell periods as well as acceleration and deceleration periods can be modulated in order to achieve improved uniformity. For example, different waveforms specifying one or more accelerations, decelerations, and dwell times, may be used in the form of program instructions in a controller electrically connected with the apparatus. In one example the controller can include program instructions for (a) rotating the substrate at a first rate for a first angular span; (b) decelerating the substrate from the first rate to a second rate for a second angular span; (c) rotating the substrate at the second rate for a third angular span; (d) accelerating the substrate back to the first rate for a third angular span, wherein (a)-(d) are carried out during one full rotation of the substrate (corresponding to 360 degree angular span).

The methods provided herein can be integrated into the processes that employ photolithographic patterning. In one aspect, the methods include any of the methods described above and further include applying photoresist to the wafer substrate; exposing the photoresist to light; patterning the photoresist and transferring the pattern to the wafer substrate; and selectively removing the photoresist from the wafer substrate. In another aspect of the invention, a system is provided, which includes any of the apparatuses described above and a stepper.

In some embodiments, an apparatus is provided, wherein the apparatus further includes a controller comprising program instructions and/or logic for performing any of the methods described herein. In one aspect a non-transitory computer machine-readable medium comprising program instructions is provided. The program instructions for control of an electroplating apparatus comprise code for performing any of the methods described above.

These and other features and advantages of the present invention will be described in more detail below with reference to the associated drawings.

BRIEF DESCRIPTION OF THE DRAWINGS

FIG. 11 C is an experimental plot showing radial distribution of normalized plated thickness at a selected azimuthal position for experiments A and C.

FIG. 11 D is an experimental plot showing 3-dimensional distribution of normalized plated thickness for experiments A and C.

FIG. 11 E is an experimental plot showing radial distribution of normalized plated thickness at a selected azimuthal position for experiments A and D.

FIG. 11 F is an experimental plot showing 3-dimensional distribution of normalized plated thickness for experiments A and D.

DETAILED DESCRIPTION

Methods and apparatus for electroplating a metal on a substrate with improved azimuthal uniformity are provided. Embodiments are described generally where the substrate is a semiconductor wafer, however the invention is not so limited. The terms "semiconductor wafer" and "semiconductor substrate" are used herein interchangeably and refer to a workpiece that contains semiconductor material, such as silicon, anywhere within the workpiece. Typically the semiconductor material in the semiconductor substrate is covered with one or more layers of other materials (e.g., dielectric and conductive layers). The substrates used for electroplating include a conductive seed layer which is exposed at least at some positions on the surface of the substrate. The seed layer is typically a layer of metal, and may be, for example, a copper layer (including pure copper and its alloys), a nickel layer (including NiB and NiP layers), a ruthenium layer, etc. The substrate typically has a number of recessed features on its surface that are filled during the electroplating process. Examples of metals that can be electroplated using provided methods include, without limitation, copper, silver, tin, indium, chromium, a tin-lead composition, a tin-silver composition, nickel, cobalt, nickel and/or cobalt alloys with each other and with tungsten, a tin-copper composition, a tin-silver-copper composition, gold, palladium, and various alloys which include these metals and compositions.

Figure 1:
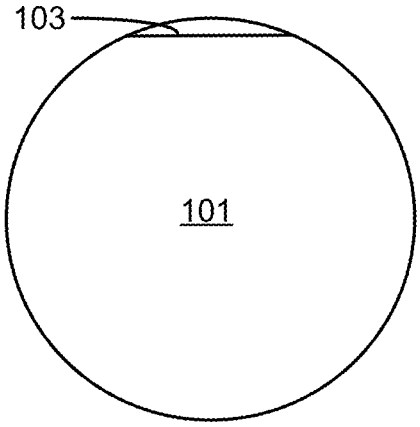
FIG. 1 is a schematic top view of an azimuthally asymmetric substrate having a missing die region.

The methods are particularly useful for electroplating on azimuthally asymmetric substrates, that is, on substrates that have different properties at different angular (azimuthal) positions at a selected fixed radial position. Examples of azimuthally asymmetric substrates include wafers with azimuthally asymmetric geometry (e.g., wafers with one or more notches at the edge, or with a flat region cut along a chord of the wafer), as well as circular wafers having azimuthally asymmetric patterning on the surface. Such asymmetry within the features on the substrate may result in unwanted ionic current crowding during plating, and can lead to increased plating at certain azimuthal regions of the wafer. For example, in some embodiments electroplating is performed on a substrate having a missing die. Electroplating on such substrate leads to current crowding in the areas that are adjacent to the azimuthally variable patterning such as in areas adjacent to a region of missing recessed features and missing die, and, consequently, to plating non-uniformity in this region. A specific example of a wafer having an azimuthally asymmetric missing die region is schematically shown in FIG. 1. The circular wafer 101 contains a patterned region and an unpatterned region 103, where the unpatterned region is azimuthally asymmetric (it's not present at all angular positions along a given radial position). When referring to through resist electroplating processes, the unpatterned region is typically covered with photoresist such that the underlying seed layer is not exposed, whereas the patterned region contains exposed conductive seed layer at bottom portions of recessed features, and exposed photoresist elsewhere. Ionic current crowding and thicker-than-desired electroplating will be experienced in such substrate at the exposed seed layer in a region directly adjacent to unpatterned photoresist.

Figure 2:
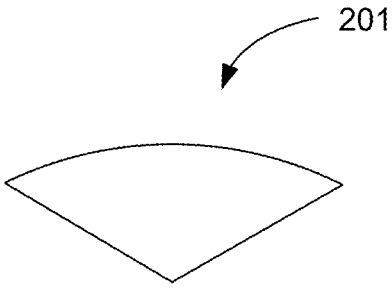
FIG. 2 is a schematic top view of an azimuthally asymmetric shield according to an embodiment presented herein.

The ionic current crowding that arises due to azimuthal asymmetry can be corrected to some degree with shields that are configured to provide azimuthally asymmetric shielding. For example, a dielectric wedge-shaped shield can be placed on the path of ionic current, and the substrate can be rotated during electroplating such that a selected azimuthal region where the correction is needed dwells in the shielded area for a longer time than an analogous region at a different azimuthal (angular) position. For example the rotating wafer may slow down when the missing die region passes through the shielded area and then will accelerate to a higher rotation rate after the missing die region exits the shielded area. Such variable-rate rotation will result in the missing die region dwelling in the shielded area for a longer time than an analogous region (a region having the same average radial position and arc length) on the wafer located at a different azimuthal position. Thus, a reduction in current crowding at a selected azimuthal position can be achieved. An example of an azimuthally asymmetric shield is shown in FIG. 2, which illustrates a top view of a wedge-like shield 201.

It was discovered that the location of the shield within the electroplating apparatus and the shape of the shield's substrate-facing surface are significant parameters that can be successfully modulated to improve plating uniformity.

One of the problems encountered during electroplating is insufficient or excessive shielding at a selected azimuthal position that results respectively in excessive or insufficient thickness of electrodeposited metal in the shielded area. This problem can arise when control over azimuthal uniformity needs to be balanced with control over radial uniformity and/or with optimization of electrolyte flow at the surface of the substrate. One feature of an electroplating apparatus that is used to mitigate terminal effect and to improve radial uniformity is an ionically resistive ionically permeable element (referred to as "the element") that is positioned between the anode and the substrate. The element is made of a resistive material and contains a plurality of channels that allow for ionic current to pass through the element towards the wafer cathode. The element introduces a resistance into the path of the ionic current, and diminishes the terminal effect which arises due to a large edge-to-center voltage drop in the conductive seed layer. The element, in some cases, is also used to shape the flow of electrolyte, as it passes through the channels of the element towards the wafer cathode. In some cases the shaping of the electrolyte flow is the primary function of the element. An example of the element is a dielectric polymeric plate that contains between about 6,000-12,000 non-communicating channels, where the element is substantially coextensive with the substrate and is spaced apart from the substrate's plating surface by about 2-10 mm. When the element is positioned in such close proximity of the substrate (which is needed for successful terminal effect mitigation), the placement of azimuthally asymmetric shields for mitigation of azimuthal non-uniformity presents a challenging problem.

Figure 3:
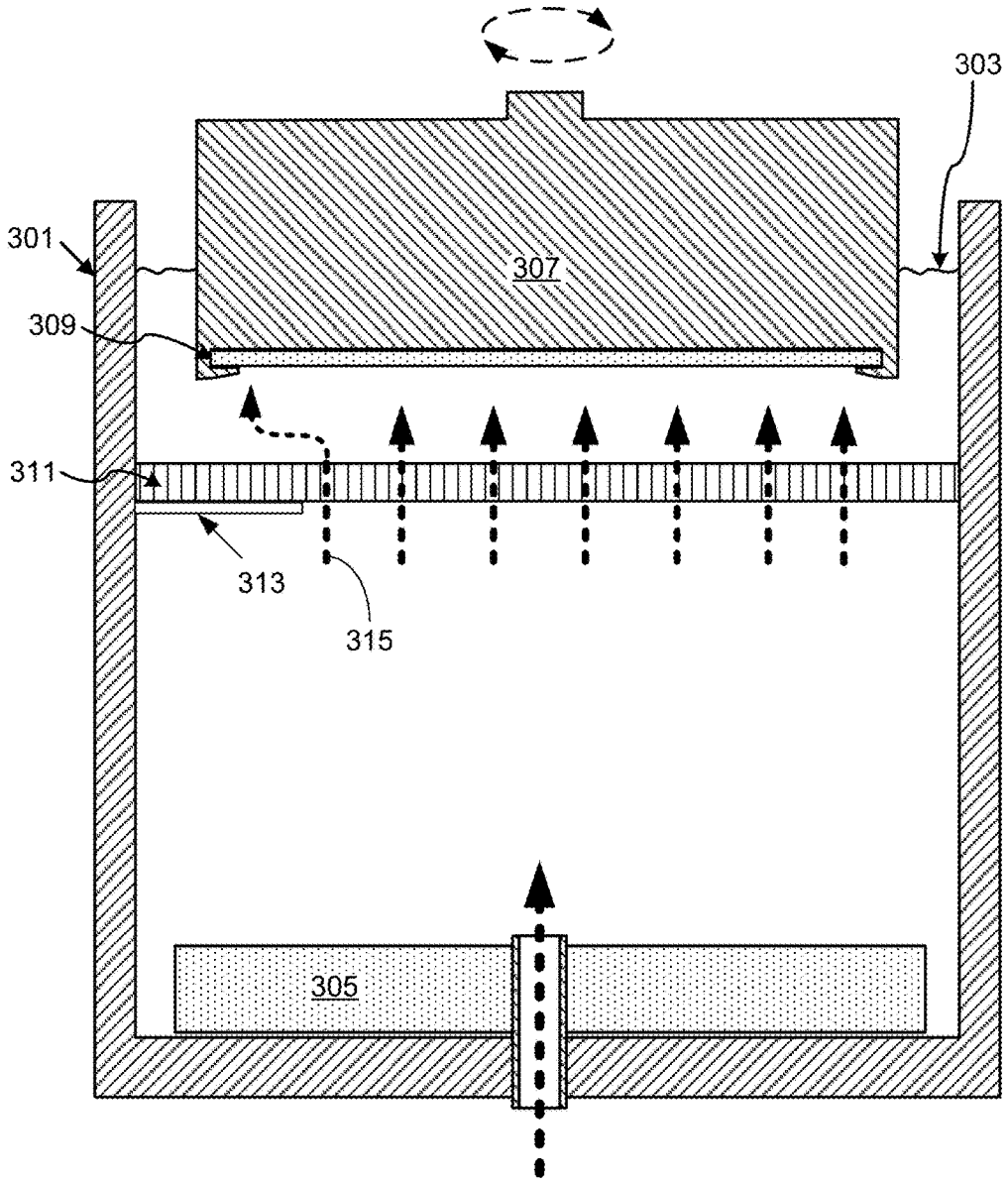
FIG. 3 is a schematic cross-sectional view of an electroplating apparatus illustrating problems encountered with the use of an azimuthally asymmetric shield positioned below the ionically resistive ionically permeable element.
Figure 4:
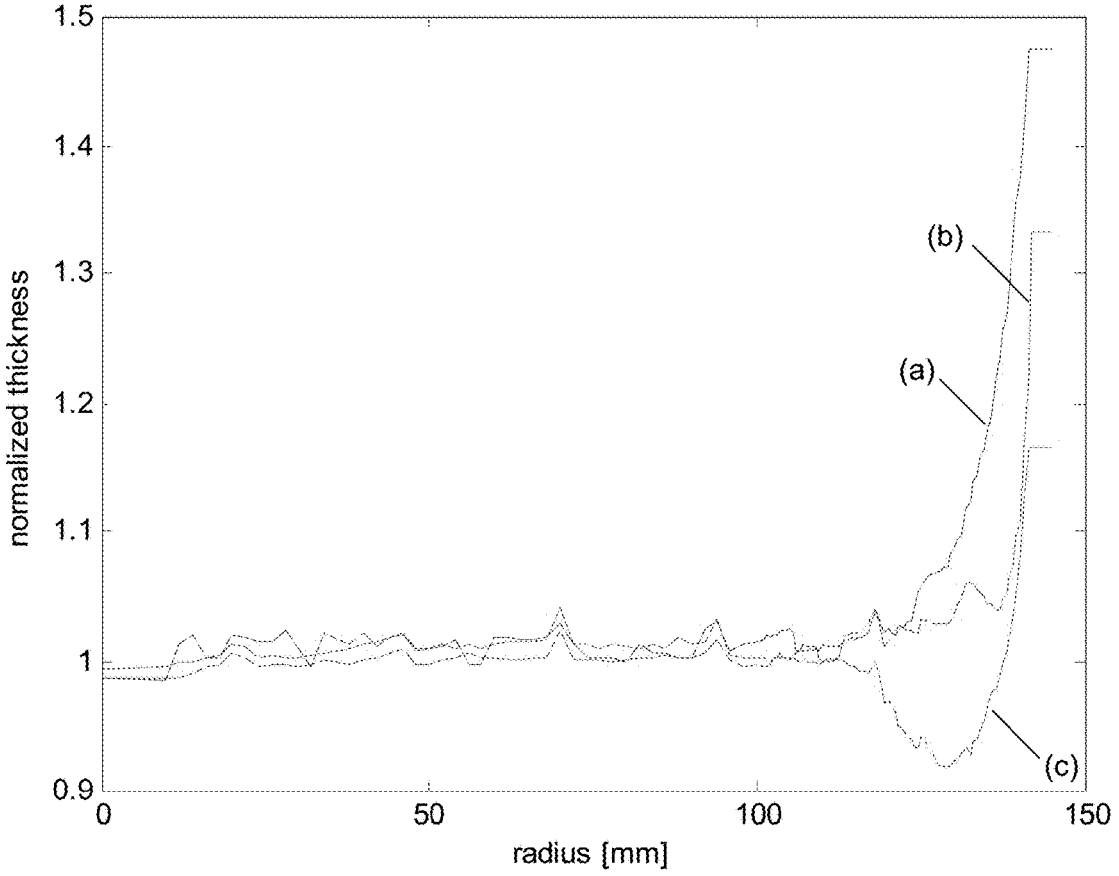
FIG. 4 is an experimental plot illustrating plated thickness distribution as a function of radial position at a selected azimuthal position for several apparatus configurations that need improvement.

It was discovered that if an azimuthally asymmetric shield is positioned directly at the bottom of the element or the top of the element at a distance of greater than 2 mm from the surface of the substrate, while contacting the element and blocking the channels of the element, the correction of azimuthal non-uniformity can be insufficient. Similarly, if instead of a separate azimuthally asymmetric shield, the shield is built-in into the element, by blocking channels at selected azimuthal position (or by having a channel-free region at the selected azimuthal position), the correction of azimuthal non-uniformity may also be insufficient. This effect is particularly pronounced if the distance between the plating surface of the substrate and the substrate-facing surface of the element is 1% or more of the diameter of the substrate. Thus, for example, this effect is observed when the element is located at 3 mm or more from the surface of a wafer having a diameter of 300 mm. This effect is illustrated with reference to FIG. 3 which shows a schematic cross-sectional view of an apparatus having an azimuthally asymmetric shield positioned directly below the element, and with reference to FIG. 4 which illustrates radial electrodeposited thickness profiles at a selected azimuthal position, obtained with and without azimuthal non-uniformity corrections in an apparatus set up as shown in FIG. 3. Referring to FIG. 3, an electroplating apparatus includes a plating chamber 301 configured to hold an electrolyte 303 and an anode 305. The apparatus further includes a substrate holder 307 configured to hold and rotate the semiconductor substrate 309. The semiconductor substrate 309 is electrically connected to a power supply (not shown) and is cathodically biased during electroplating. An ionically resistive ionically permeable element 311 resides in proximity of the substrate 309, and allows ionic current to pass through its channels as shown by the arrows. A portion of the channels is blocked by an azimuthally asymmetric wedge-like shield 313 located directly below the element 311. The substrate is rotated during electroplating and slows down to a lower speed when the selected azimuthal position of the wafer passes over the azimuthally asymmetric shield 313. It was discovered that when the azimuthally asymmetric shield is positioned such as shown in FIG. 3, it does not always provide sufficient shielding, because ionic current can still quite efficiently redistribute to the shielded azimuthal position of the substrate in the electrolyte above the element, as shown by the arrow 315.

Three electroplating experiments were conducted on a 300 mm wafer substrate having a missing die in an electroplating apparatus set up as shown in FIG. 3. In all three experiments a wedge-like shield was placed directly under the element at a radial position of 120 mm from the radial position corresponding to the center of the wafer (referring to the position of innermost point of the wedge), where the shield had a 114 degree wedge angle. The radial distribution of metal thickness was measured at an azimuthal location in proximity to the missing die region. In a first experiment, there was no azimuthally asymmetric shielding (the wafer was spinning at a constant rate of 4 rpm). The resulting thickness profile at the selected azimuthal location is shown by curve (a). It can be seen that there is a large increase in thickness at the peripheral portion of the wafer corresponding to the current crowding near the missing die region as expected. In a second experiment the wafer was spun such that the missing die region dwelled longer in the shielded area. Specifically, the wafer was spinning at 24 rpm, but slowed down to 1 rpm for a 10 degrees span, when the missing die region was passing over the shield. The resulting thickness profile is shown by curve (b). The uniformity was improved, but the profile at the edge of the wafer was still not sufficiently flat, and current crowding persisted. In a third experiment, larger azimuthal correction was used, while all electroplating conditions were the same as in the second experiment. The larger azimuthal correction was obtained by slowing down the wafer over a larger span in the shielded area. Specifically, the wafer was spinning at 24 rpm but slowed down to 2 rpm for a 30 degrees span, when the missing die region was passing over the shield. The thickness profile obtained in the third experiment is illustrated by curve (c). It can be seen that curve (c) exhibits a portion of lower-than-needed thickness in an overshielded region at the periphery of the substrate. The position of the element was the same in all three experiments, and the distance from the substrate-facing surface of the element to the plating surface of the substrate (a 300 mm wafer) was 4.5 mm. The thickness of the element was 12.7 mm. These experiments illustrate that when the shield is positioned so far from the wafer substrate, it is difficult to find the balance between overshielding and undershielding because the ionic current has ample opportunity to redistribute in close proximity of the substrate. A similar effect is expected if a thin azimuthally asymmetric shield is positioned directly on top of a relatively remotely positioned element (at 3-10 mm) while blocking the elements' holes.

It was discovered that azimuthal uniformity can be improved by using azimuthally asymmetric shields positioned above the element in extreme proximity of the substrate and, in some embodiments, but not necessarily, separated from the element by a gap. Preferably the closest distance between the platable surface of the substrate and the substrate-facing surface of the shield is 0.7% of the diameter of the substrate or less, such as 0.4% of the diameter of the substrate or less. Specifically the closest distance between the substrate-facing surface of the shield, and the working surface of the substrate should be 2 mm or less, preferably between about 0.5-1.5 mm. For example the azimuthally asymmetric shield can be positioned such that it is separated from the surface of the substrate by a distance of about 0.5-1.5 mm when a 300 mm wafer is processed (referring to the closest distance, if the distance is varied due to contouring of the substrate-facing surface of the shield). The use of such small wafer-to-shield spacing makes it difficult for the ionic current to redistribute to the shielded area, and results in more complete shielding from unwanted current. The substrate-facing surface of the element is in some embodiments, separated from the azimuthally asymmetric shield by a gap, which is useful for allowing an unimpeded transverse flow of electrolyte between the element and the substrate. The gap is, in some embodiments, between about 0.1-1.7% of the diameter of the substrate. For example, when a 300 mm wafer is processed, a gap of between about 0.5-5 mm can be used. In addition, preferably, when the gap between the element and the azimuthally asymmetric shield is present, at least a portion of the non-communicating channels of the element falling into a projection of the shield should be blocked to ionic current flow. For example a second shield can be placed in direct contact with the element that would block the channels of the element to ionic flow, or the element can be manufactured such that the channels are absent in the selected area of the element. When the configuration contains two azimuthally asymmetric shields the shield residing over the element and closer to the substrate in wafer face-down configuration is referred to as the "top shield", whereas the shield residing below the element is referred to as the "bottom shield".

As it was previously mentioned, the ionically resistive ionically permeable element (also referred to as "the element") is a component of an electroplating apparatus that provides an additional resistance on the path of ionic current towards the cathodically biased wafer substrate, and that allows for movement of ions through the element towards the substrate during electroplating.

In some embodiments the element is a plate having a plurality of non-communicating channels, where the body of the plate is made of a resistive material, and the channels in the resistive material allow for movement of the ions through the plate towards the cathodically biased substrate. The element has a substrate-facing surface that is preferably (but not necessarily) planar and parallel to the substrate, and an opposing surface, which may be planar or curved. The element is positioned in close proximity of the substrate, but does not contact the substrate. Preferably the element is positioned within about 10 mm of the substrate, more preferably within about 5 mm of the substrate, where the number refers to a closest distance between the plating face of the substrate and the substrate-facing surface of the element.

In some embodiments the maximum thickness of the element ranges between about 10 to about 50 mm, and the minimal porosity is typically in the range of between about 1-5%. The porosity is determined as a ratio of the area of channel openings on the substrate-facing surface of the element to the total area of the substrate-facing surface of the element.

An example of an element with non-communicating through holes is a disc made of an ionically resistive material, such as polyethylene, polypropylene, polyvinylidene difluoride (PVDF), polytetrafluoroethylene, polysulphone, polyvinyl chloride (PVC), polycarbonate, and the like, having between about 6,000-12,000 1-D through-holes. In some implementations the element may further serve an electrolyte flow-shaping function, and may allow for large volume of electrolyte to pass through the channels of its body and provide an impinging flow of electrolyte at the wafer surface. The diameters of the channels should not be larger than the distance between the substrate and the substrate-facing surface of the element, and typically the diameters should not exceed 5 mm. Typically the diameters of the channels are in a range of between about 0.5-1 mm. For example the channels may have diameters of 0.508 mm or 0.66 mm. The channels may be directed at a 90 degree angle to the substrate-facing surface of the element, or at a different angle of incline.

The azimuthally asymmetric shields provided herein are typically made of dielectric materials that are compatible with the electrolytes that are being used (often acidic electrolytes). For example the shields may be made of acid-resistant polymeric materials. The geometry of the shields can be tailored for the specific non-uniformity that is being corrected. In some embodiments the substrate-facing surface of the top shield is contoured. The term "contoured" as used herein refers to the shape of the surface that provides at least two different distances from the substrate-facing surface of the shield to the working surface of the substrate. In some embodiments the substrate-facing surface of the shield is contoured in a radial direction, such that distances from the shield to the substrate at two different radial positions and same azimuthal position are varied. In some embodiments it is preferable to provide shields that can be positioned such that there is a smaller distance to the substrate at a greater radial position (which is closer to the periphery of the substrate) than at a smaller radial position (closer to the center). For example edge-thick wedge-like shields can be used. In some embodiments the substrate-facing surface of the top shield is contoured such that the distance towards the substrate gradually varies in a radial direction (e.g., becomes smaller with increasing radial position towards the periphery). In some embodiments the top azimuthally asymmetric shield has one or more openings that allow for the electrolyte to pass through them and to modulate the ionic current environment in the shielded area. The azimuthally asymmetric shields, in some embodiments have an annular portion releasably or fixedly attached to the inner wedge-like portion that can be used for mounting the shield within the electroplating chamber and/or to provide a certain amount of symmetric shielding at the periphery of the substrate. In a preferred embodiment the top azimuthally asymmetric shield is stationary and the substrate is rotated relative to the stationary shield.

FIGS. 5A-5D illustrate various embodiments of possible configurations of shields that can be used for improving azimuthal uniformity. For clarity, only a portion of an apparatus containing the element, the shields and the substrate is shown.

Figure 5A:
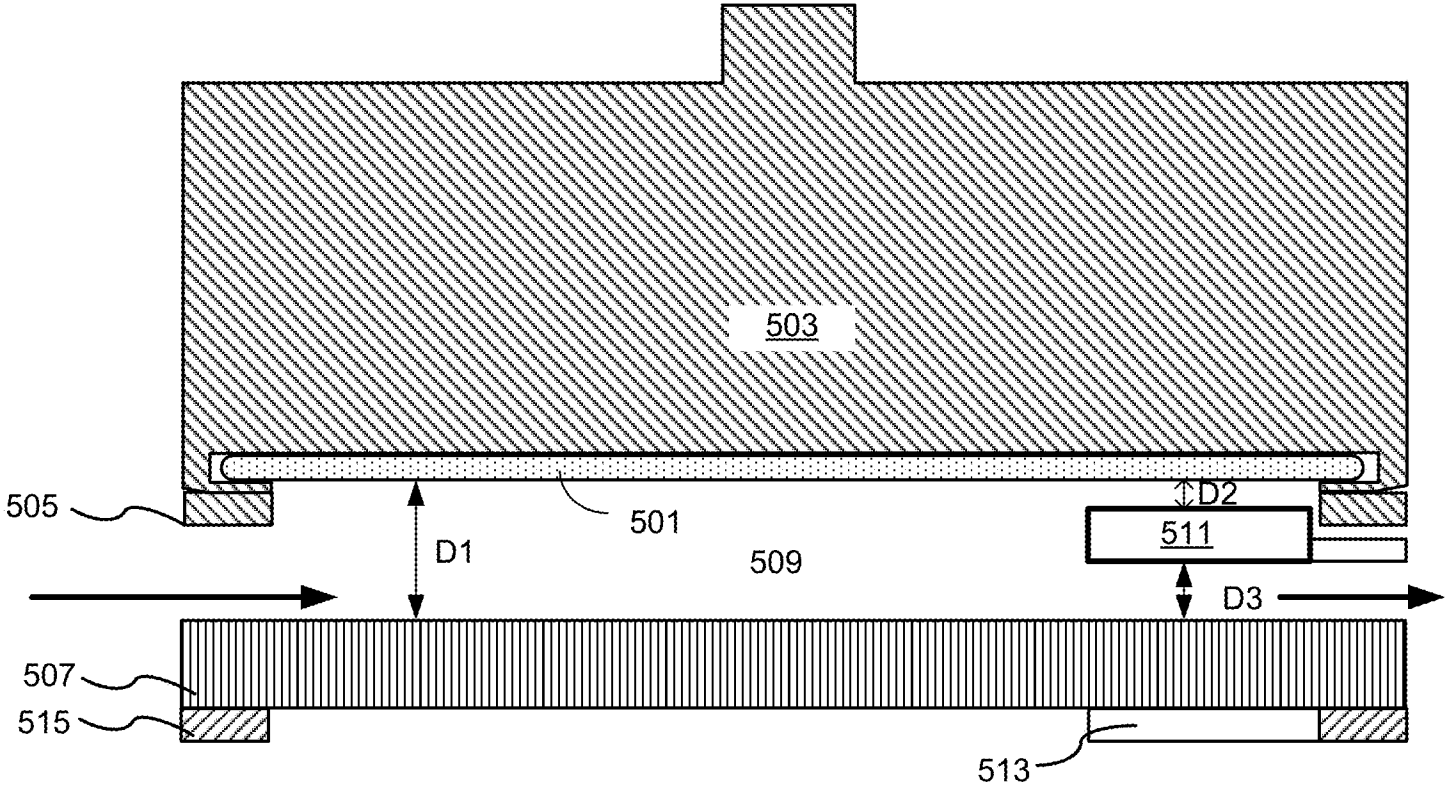
FIGS. 5A-5D are schematic cross-sectional diagrams of a portion of an apparatus illustrating positioning of azimuthally asymmetric shields according to various embodiments presented herein.

One embodiment of the provided apparatus is illustrated by FIG. 5A, which shows a schematic cross-sectional view of a portion of a plating chamber in the proximity of the wafer substrate. The wafer substrate 501 is held in place by a substrate holder 503, which is configured to rotate the substrate during electroplating. The substrate holder also contains a plurality of electrical contacts which are electrically connected with the wafer substrate 501 at the periphery of the substrate. The substrate is immersed with its platable surface into electrolyte during electroplating and is negatively biased. A portion of the substrate holder referred to as a cup, 505, protrudes a short distance beyond the platable surface of the substrate towards the element 507. The element 507 is positioned at a distance D1 (less than 10 mm) from the platable surface of the substrate, such that a microchamber 509 is formed. A wedge-shaped shield 511 is positioned in close proximity of the substrate, such that the substrate-facing surface of the shield is separated from the platable surface of the substrate by a distance D2 (less than 2 mm, preferably from about 0.5-1.5 mm). The bottom surface of the shield 511 is separated from the top surface of the element 507 by a distance D3. In the depicted embodiment electrolyte is provided into the microchamber 509 through an opening on the side and exits the microchamber through another opening at an azimuthally opposing position, as shown by the arrows. In the depicted embodiment the outlet for the electrolyte is provided at the periphery of the gap between the shield 511 and the element 507. Concurrently, a second portion of electrolyte flows upwards through the channels of the element 507. A wedge-like azimuthally asymmetric shield 513 is located at the bottom surface of the element 507, such that it blocks the channels of the elements to the flow of the ionic current. In the depicted embodiment this bottom shield is coextensive with the top shield 511, but, generally the amount of bottom shielding can be varied and can be used to tune the amount of current passing through the element below the top shield 511. An optional annular symmetric shield 515 resides at the bottom of the element 507, blocking the channels at the outer periphery of the element.

Figure 6A:
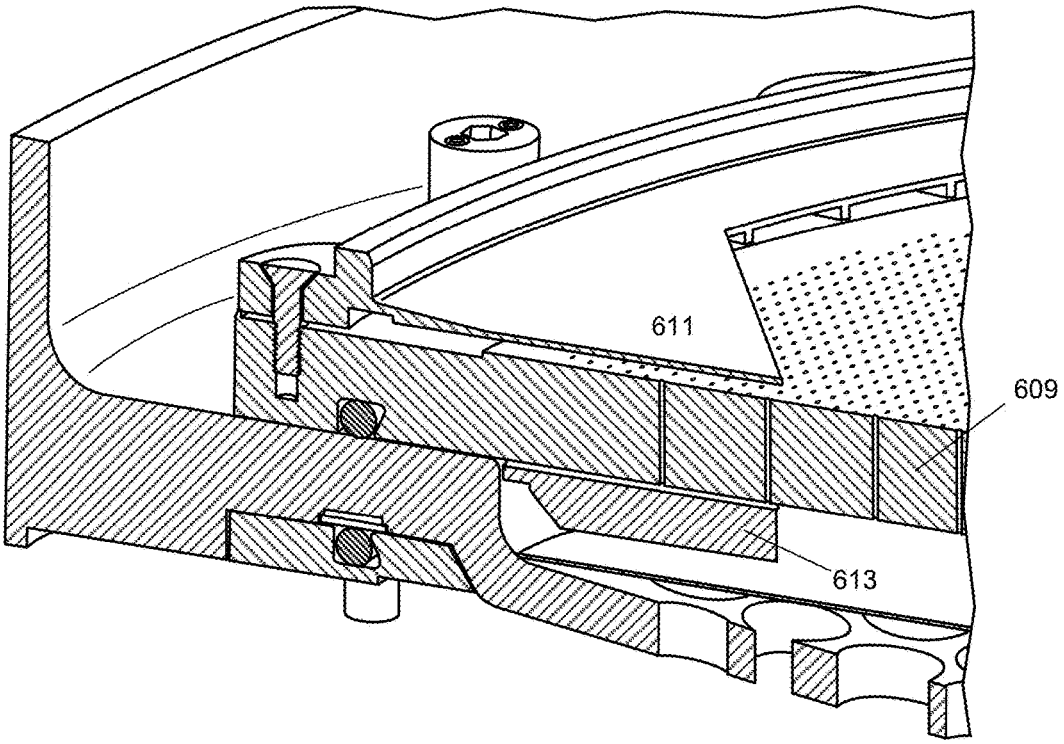
FIGS. 6A-6D provide perspective views of various azimuthally asymmetric shields and assemblies comprising the shields, according to various embodiments presented herein.

A perspective view of an assembly having coextensive bottom and top wedge-like shields is shown in FIG. 6A. In this view the top shield 611 resides over the element 609 and is separated from the element by a small gap. The entire projected area of the shield 611 onto the element is blocked to ionic flow by a bottom wedge-like shield 613, which contacts the bottom surface of the element and blocks ionic current flow in this area.

Figure 5B:
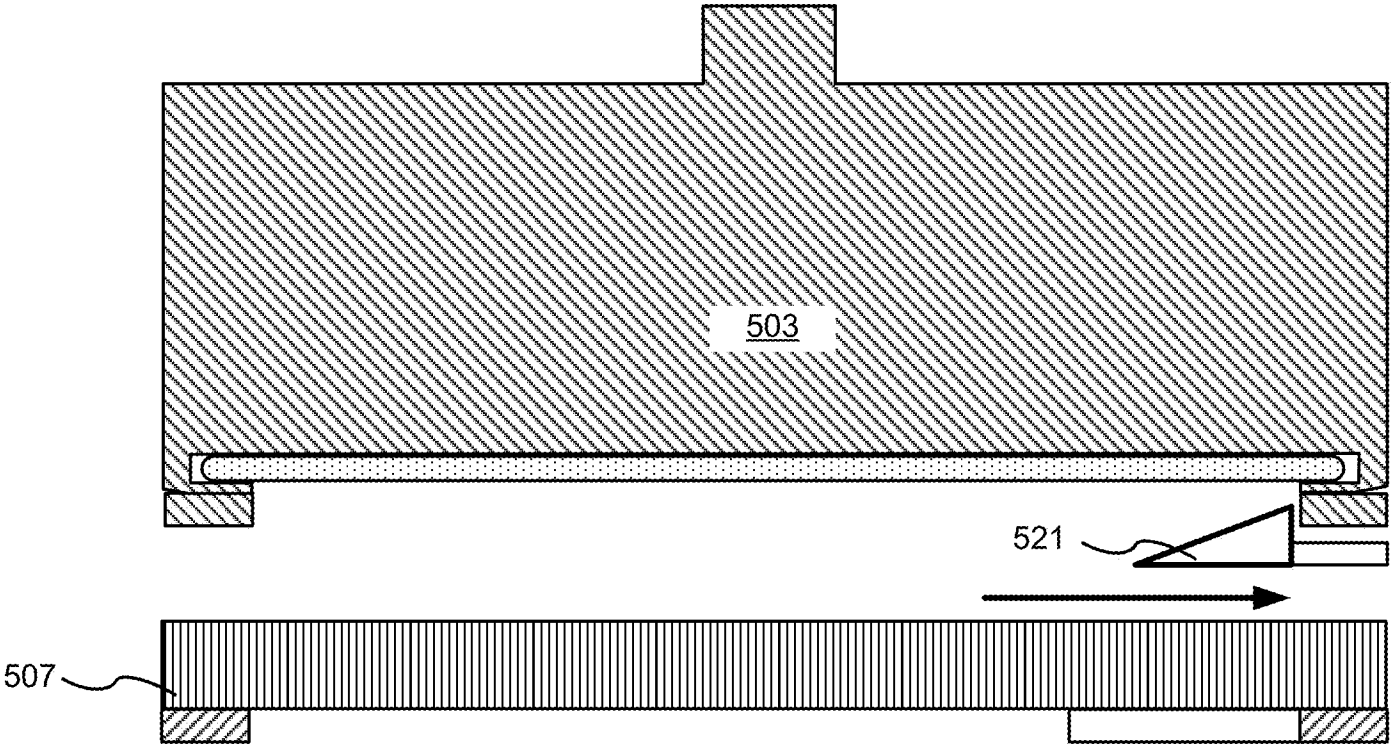
Figure 6B:
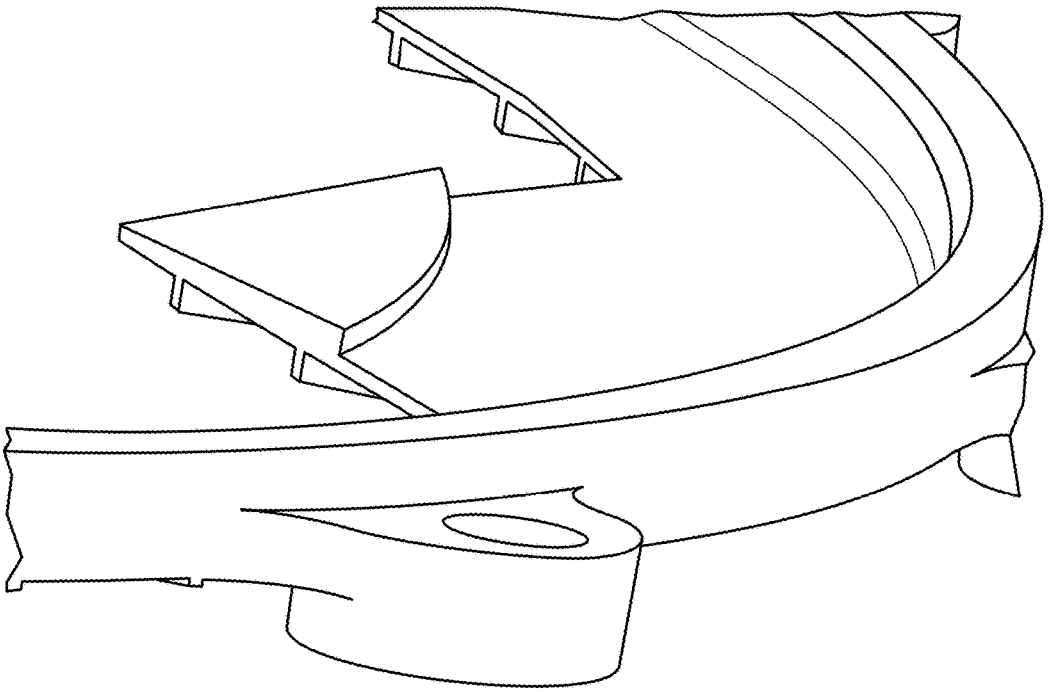
Figure 6C:
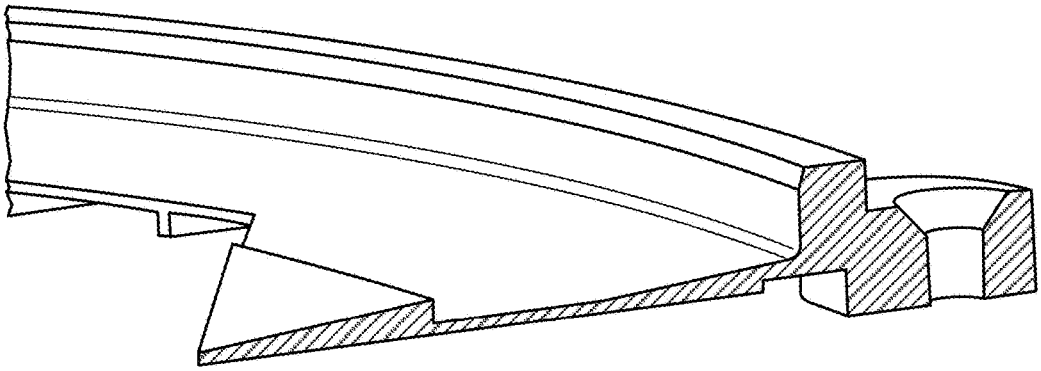

In the embodiments depicted in FIGS. 5A and 6A the top shield has a flat substrate-facing surface and constant distance to the surface of the substrate. In other embodiments, the distance from the platable surface of the substrate to the substrate-facing surface of the shield is varied. For example, the top surface of the shield may be contoured such that the distance to the substrate is smaller at the periphery of the shield than in the central portion of the shield. Variation in this distance provides an additional way to modulate distribution of ionic current at the surface of the substrate. It was discovered that contouring of the top surface of the shield (such that the distance between the substrate-facing surface of the shield and the working surface of the substrate is varied), is a particularly effective method for modulating ionic current distribution, if the shield is positioned in extreme proximity of the substrate (less than 2 mm, such as 1.5 mm or less, referring to the closest distance between the substrate-facing surface of the shield and the working surface of the substrate), and loses its effectiveness if the shield is positioned further away from the substrate. A cross-sectional view of a portion of an apparatus illustrating this embodiment is shown in FIG. 5B, where all of the elements of the apparatus are arranged as in the apparatus of FIG. 5A, but the top shield 521 has variable thickness and is positioned such that it is facing the element with its flat surface. In this example the distance from the top surface of the shield to the substrate is gradually decreased in a radial direction towards the edge of the substrate. Perspective views of such variable-thickness top shields are shown in FIGS. 6B and 6C.

Figure 5C:
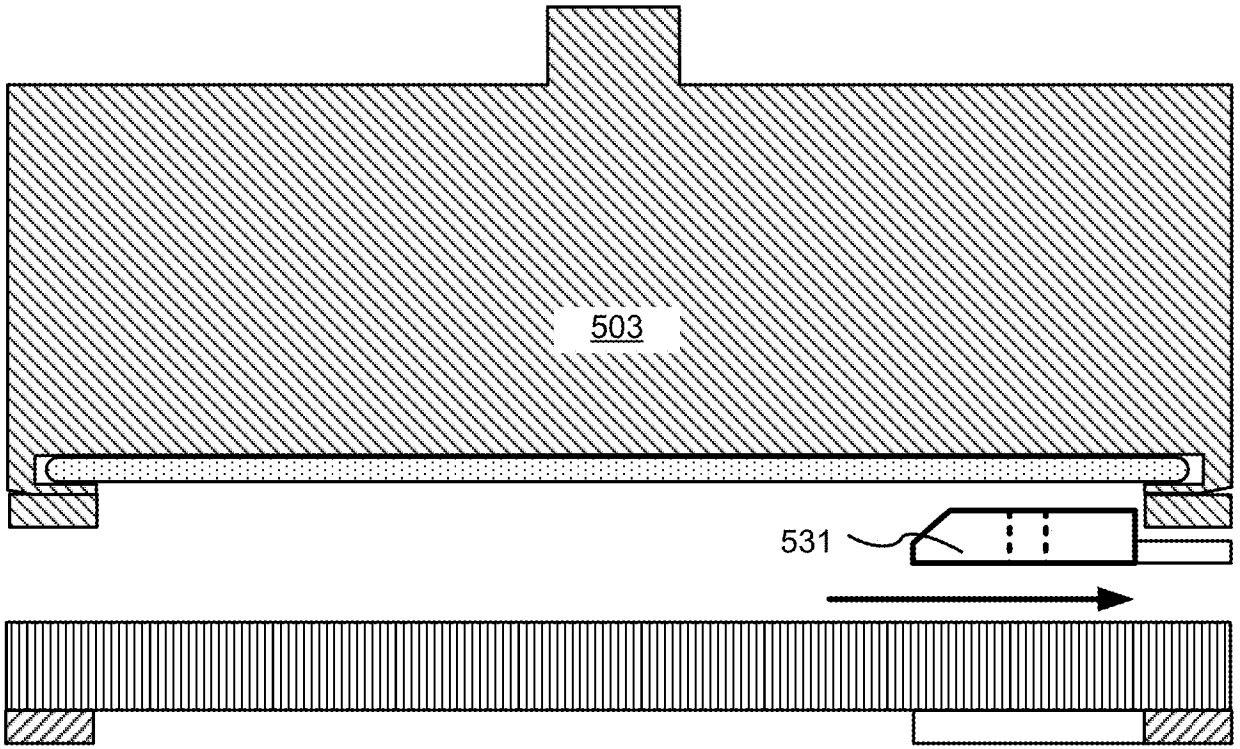
Figure 6D:
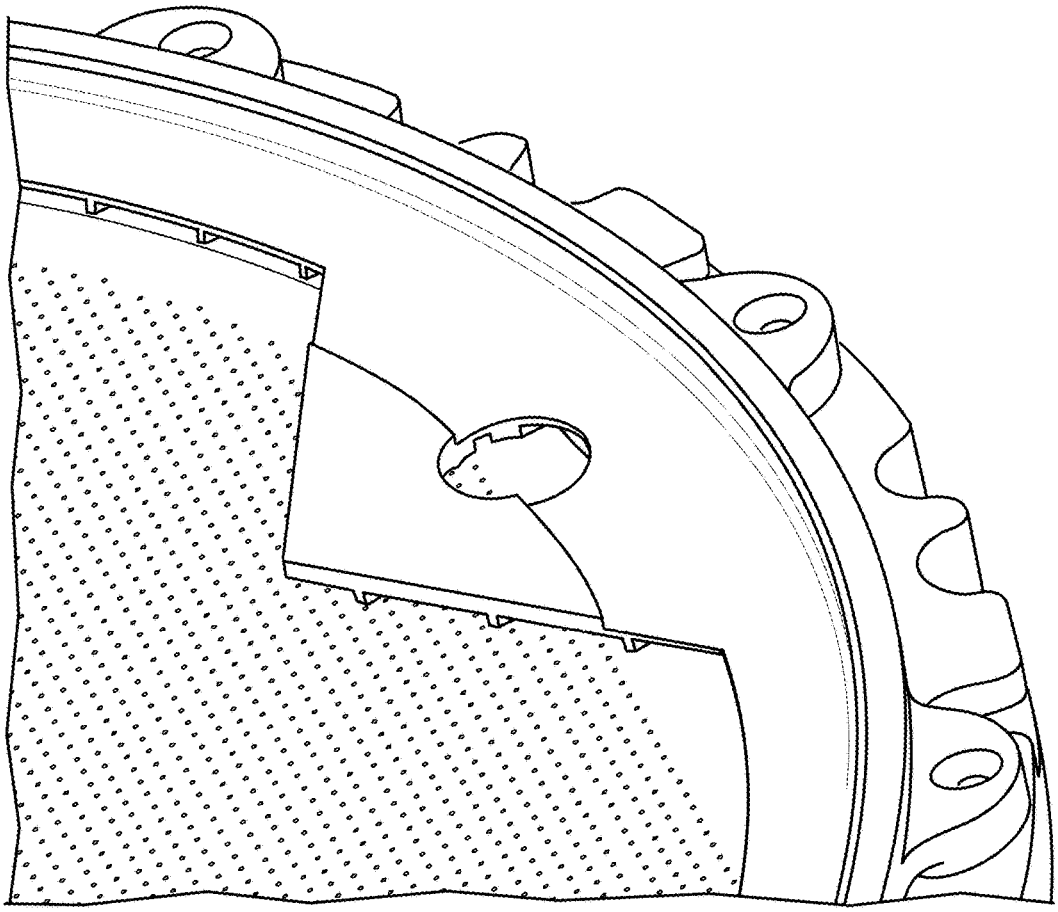

In some embodiments the top shield may have one or more openings that would allow the passage of ionic current through the shield. The presence of the openings can be advantageous for modulating current in the shielded area, as the shield would allow for some current to pass through and may prevent overshielding. FIG. 5C shows a cross-sectional view of an apparatus that has a top shield 531 that has both contoured top surface and one opening in the shield (shown as the dashed line). FIG. 6D shows a perspective view of another embodiment, in which the shield is not contoured, but has one large opening for passage of ionic current, over an ionically resistive ionically permeable element.

Figure 5D:
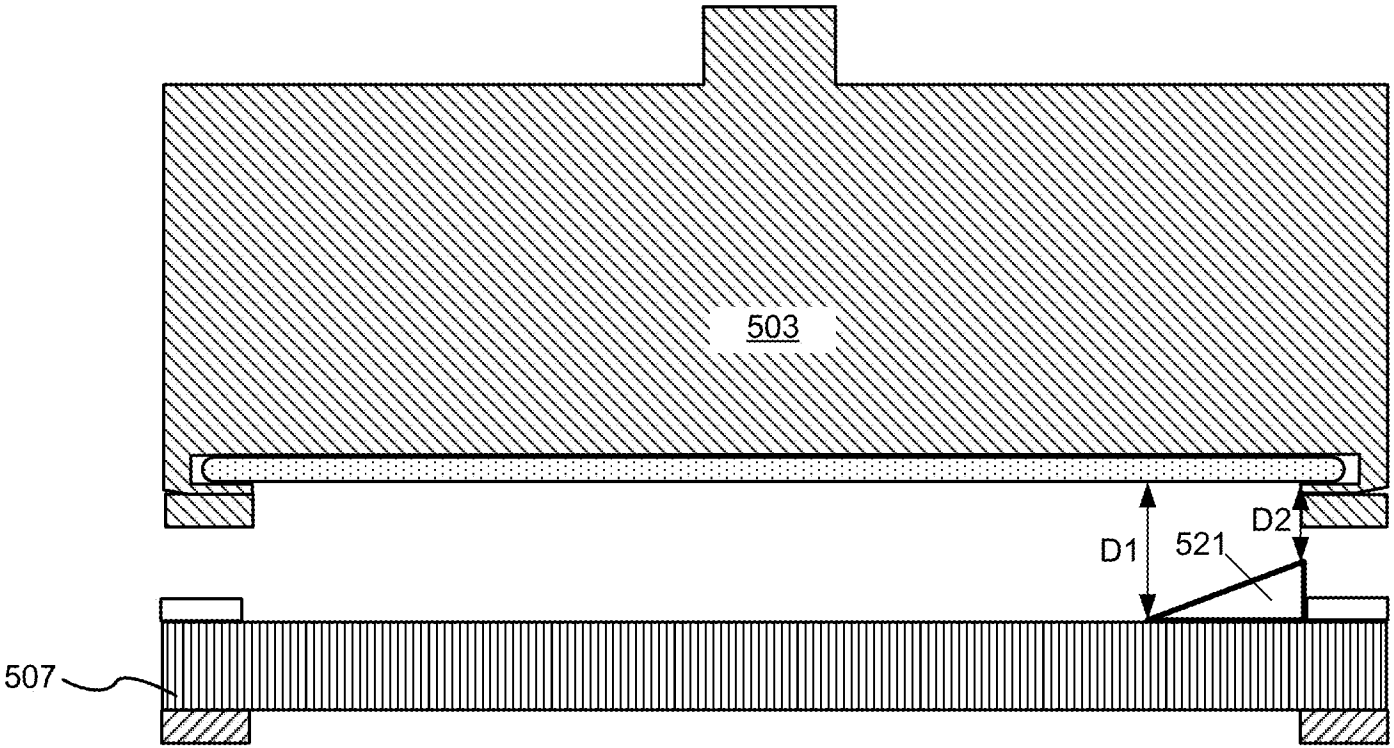

While the presence of the gap between the element and the top shield is advantageous for transverse flow, in some embodiments the top shield 521 can reside directly in contact with the element 507 as shown in FIG. 5D. The closest distance from the substrate-facing surface of the shield to the working surface of the substrate, D2, is less than about 2 mm, preferably between about 0.5-1.5 mm. The largest distance between the substrate-facing surface of the shield and the working surface of the substrate, in the depicted embodiment is the same as the distance from the substrate to the element D1, and can be, for example, between about 2.5-9 mm. It is noted that when the top shield resides directly on top of the element and blocks the holes of the element to flow, the presence of the bottom shield is not needed, because the top shield already accomplishes the hole blocking function.

While not illustrated by the drawings, it is understood that all types of top shields shown in FIGS. 5A-5C (with flat substrate-facing surface, with contoured substrate-facing surface, and with one or more openings) can be used in a configuration where the top shield is placed directly in contact with the element as was shown in FIG. 5D, provided the closest distance between the substrate-facing surface of the shield and the working surface of the substrate is less than 2 mm.

Figure 7A:
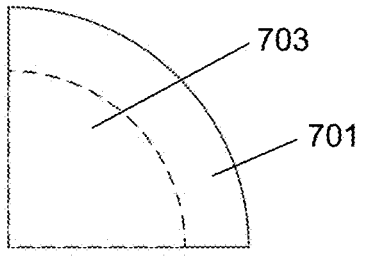
FIGS. 7A-7C provide schematic top views for different relative arrangements of top and bottom shields provided herein.
Figure 7B:
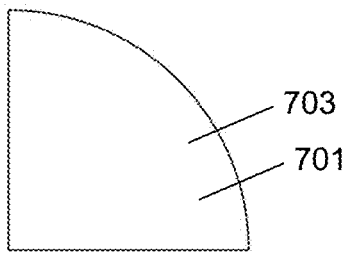
Figure 7C:
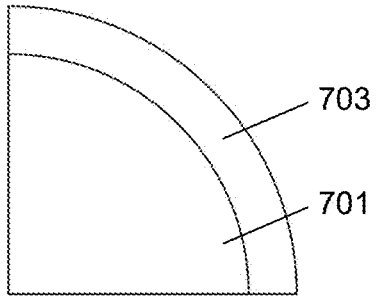
Figure 7D:
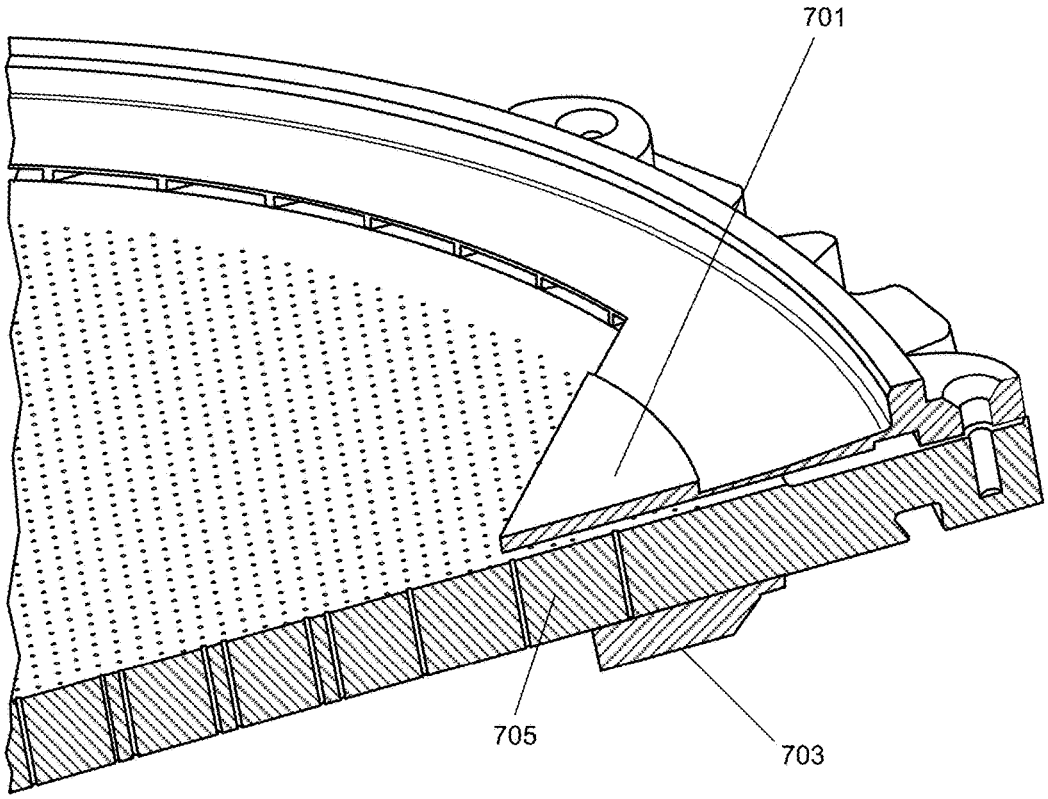
FIG. 7D is a perspective view of a portion of an apparatus illustrating relative positions of top and bottom shields in accordance with an embodiment provided herein.

Another parameter that can be modulated in order to obtain a desired current profile at the wafer is the relative areas occupied by the top and bottom azimuthally asymmetric shields, when both shields are used. Preferably, at least a portion of an area projected by the top shield onto the element is blocked to ionic current. In some embodiments the blocked area is smaller than the total area of the projection of the top shield. For example, the ionic current can be blocked by a bottom shield contacting the element and occupying between about 60-99%, such as 70-95% of the total area of the projection. FIG. 7A shows a schematic top view of a top shield 701 and a bottom shield 703 residing below the top shield and occupying a smaller area than the top shield. The element residing between the shields is not shown to preserve clarity. A perspective view of a portion of an apparatus having this type of configuration is shown in FIG. 7D, where the bottom shield 703 blocks ionic current only from a portion of the area projected by the top shield 701 onto the element 705.

In some embodiments the entire projection of the top shield onto the element is blocked to ionic current while no additional area around the projection is blocked. This can be accomplished by using a bottom shield that is coextensive with the top shield. This configuration is schematically shown by FIG. 7B which shows the top view of top shield 701 over the bottom shield 703. In some embodiments, the area projected by the top shield onto the element is blocked to ionic current, and an additional area adjoining the projected area is also blocked. For example, the bottom shield having greater area (e.g., having greater length in radial direction) than the top shield can be used in some embodiments. This is illustrated by FIG. 7C, which shows that the top shield 701 has a smaller projected area than the area of the underlying shield 703.

Figure 7E:
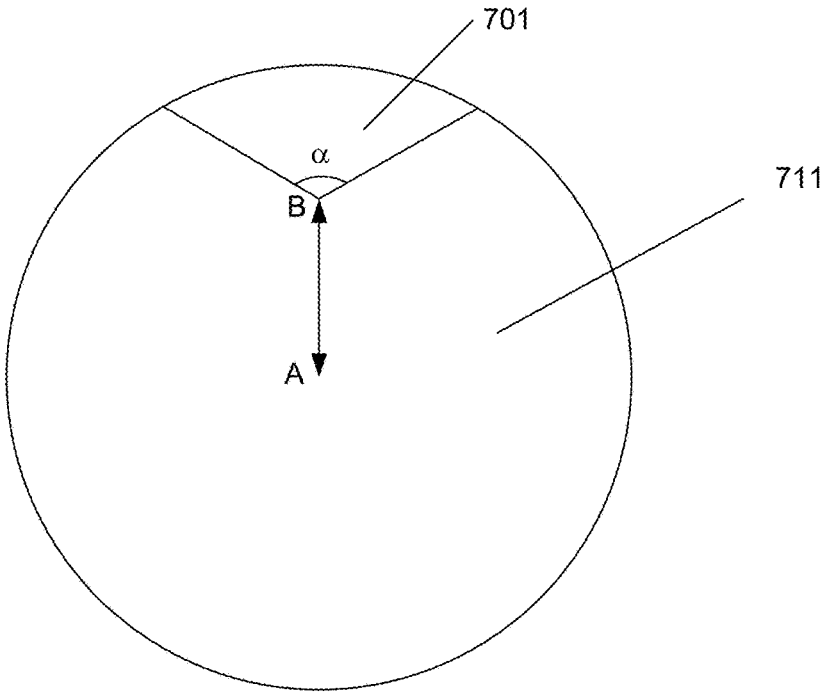
FIGS. 7E and 7F provide schematic top views for exemplary positioning of top shields.
Figure 7F:
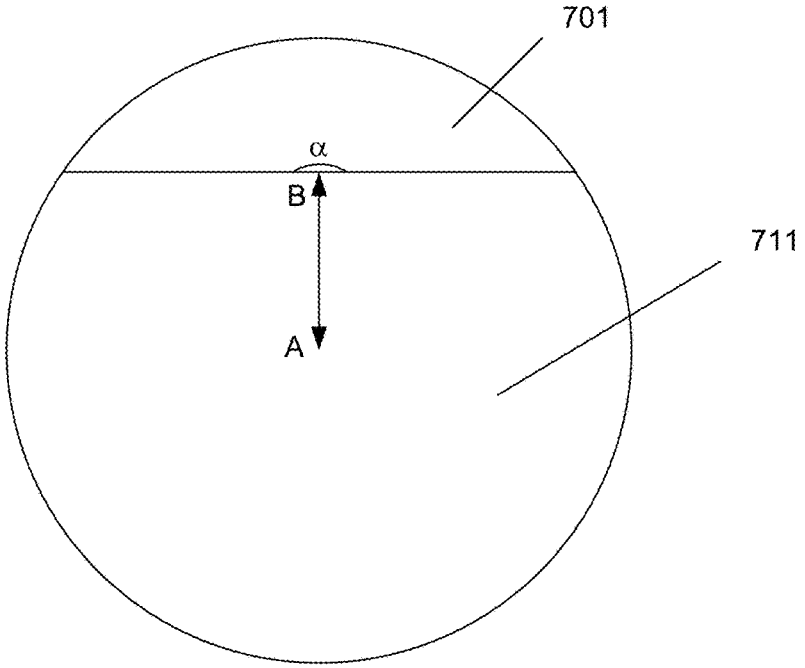

The shape and radial placement of the azimuthally asymmetric shields generally depends on the type and size of the azimuthal non-uniformity that needs to be corrected. Typically for correcting ionic current on a wafer having an unpatterned region at the edge of the wafer, a wedge-like shield is placed at radial distances that are equal to or close to radial distances of the unpatterned region. In some embodiments it is preferable to use azimuthally asymmetric shields that have a larger area than the area of the missing die region (or other region causing azimuthal non-uniformity). This is because during the slow spin portion of the spinning cycle, the entire missing die area should preferably be in the shielded area most of the time. For example, in some embodiments the wafer is spun at a slower rate for an angular span of between about 8-30 degrees, and the azimuthally asymmetric shield has an arc length that is greater than the arc length corresponding to the missing die region (or another region causing azimuthal non-uniformity). FIGS. 7E and 7F illustrate two embodiments of the top azimuthally asymmetric shield placement. FIG. 7E shows a schematic top view of azimuthally asymmetric shield 701 in relation to the projection of the wafer substrate 711 on a horizontal plane. Thus, the radial position of the center of the wafer corresponds to point A on the plane of the shield. The placement and the size of the shield can be characterized by the height AB, and by the central angle of the shield $\alpha$. In some embodiments, the central angle is between about 100-180 degrees, and the shield is placed at a height of between about 110-140 mm (when a 300 mm wafer is processed). In some embodiments, the central angle is between about 100-180 degrees, and the shield is placed (referring to point B) at a radial distance of between about 10-40 mm from the radial position corresponding to the edge of the wafer (for a wafer of any diameter). In some embodiments the shield is placed (referring to point B) at a radial position corresponding to between 60-95% of the diameter of the wafer that is being processed.

The azimuthally asymmetric shields provided herein can be used in a variety of electroplating apparatuses, including wafer face-up and wafer face-down apparatuses. An example of a wafer face-down apparatus that can incorporate the described configurations of shields and an ionically resistive ionically permeable element is Sabre 3D™ electroplating system available from Lam Research Corporation of Fremont, Calif. Generally, the electroplating apparatus includes an electroplating chamber configured to contain an electrolyte and an anode while electroplating metal onto a semiconductor substrate; a substrate holder configured to hold the semiconductor substrate such that a plating face of the substrate is separated from the anode during electroplating; an ionically resistive ionically permeable element having a plurality of non-communicating channels that allow ionic current to pass through the element; and a shield configured to provide azimuthally asymmetric shielding, wherein the shield is positioned between the element and the substrate such that the closest distance between the working surface of the substrate and the substrate-facing surface of the shield is less than about 2 mm. The substrate-facing surface of the shield may be parallel to the platable surface of the substrate or may be contoured such that the distance between this surface and the platable surface of the substrate is variable. The apparatus may also include a controller having program instructions for performing any of the methods provided herein.

Figure 8:
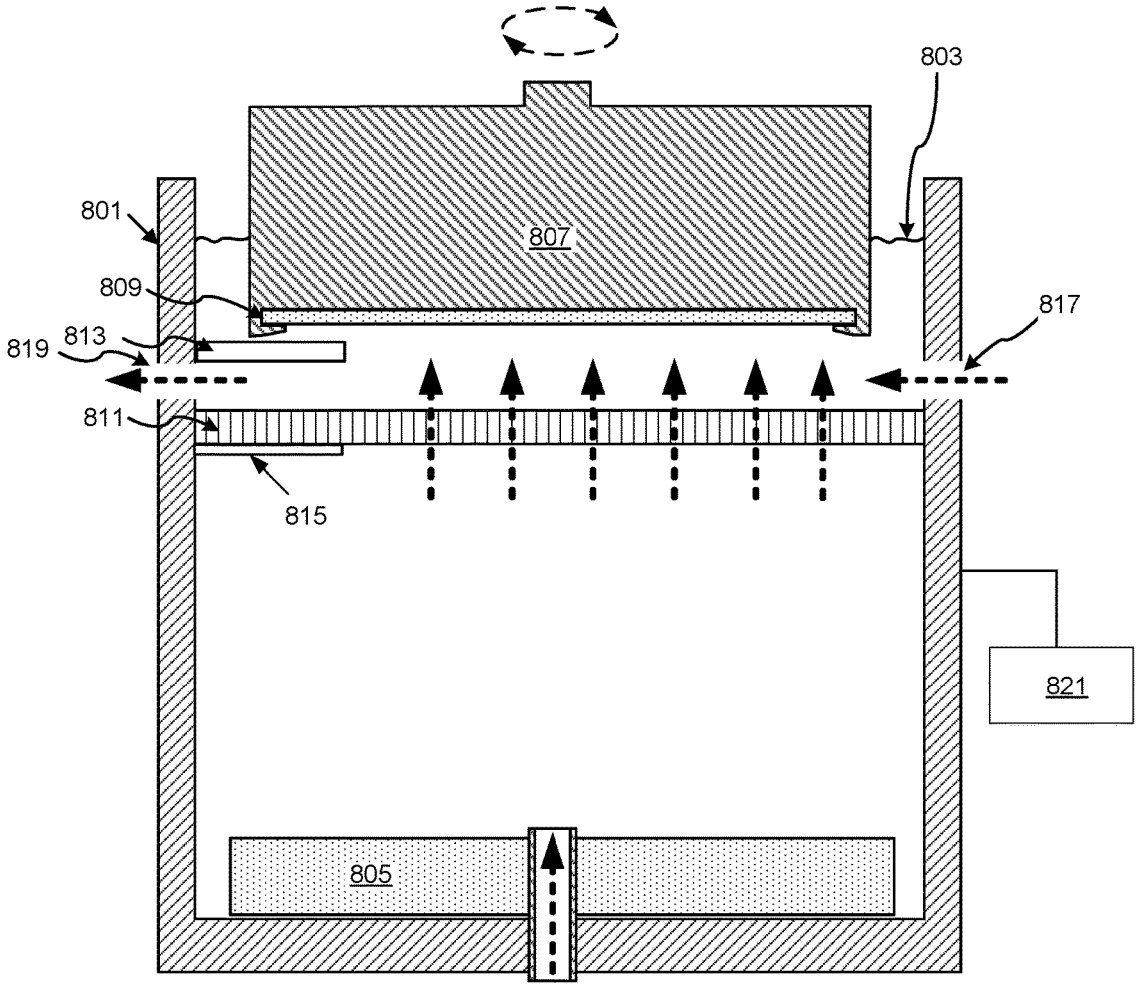
FIG. 8 is a schematic cross-sectional view of an electroplating apparatus in accordance with an embodiment provided herein.

One illustrative example of an apparatus, where the top azimuthally asymmetric shield is located in close proximity of the substrate and is separated from the ionically resistive ionically permeable element by an electrolyte-filled gap is presented in FIG. 8. A diagrammatical cross-sectional view of an electroplating apparatus is shown. The plating vessel 801 contains the plating solution (electrolyte) 803, which typically includes a source of metal ions and an acid. A wafer 809 is immersed into the plating solution in a face-down orientation and is held by a "clamshell" holding fixture 807, mounted on a rotatable spindle, which allows unidirectional or bidirectional rotation of clamshell 807 together with the wafer 809. A general description of a clamshell-type plating apparatus having aspects suitable for use with this invention is described in detail in U.S. Pat. No. 6,156,167 issued to Patton et al., and U.S. Pat. No. 6,800,187 issued to Reid et al, which are herein incorporated by reference. An anode 805 (which may be an inert or a consumable anode) is disposed below the wafer within the plating bath 801 and may be separated from the wafer region by an ion selective membrane (not shown), that divides the apparatus into anolyte and catholyte regions. An ionically resistive ionically permeable element 811 resides in close proximity of the wafer 809, is coextensive with the wafer, and is separated from the wafer by an electrolyte-filled gap of 10 mm or less. The top azimuthally asymmetric shield 813 is located between the element 811 and the wafer 809 in close proximity of the wafer, such that the closest distance between the substrate-facing surface of the shield and the working surface of the substrate is less than 2 mm. The top shield 813 is separated from the element 811 by a gap. The depicted apparatus further includes a bottom azimuthally asymmetric shield 815, which contacts the bottom surface of the element and blocks ionic current from passing through the element in an area that falls into the projection of top shield 813 onto the element 811.

In the depicted embodiment the plating solution is provided to plating bath 801 by a pump (not shown) through an entry port 817 on the side of the plating chamber above the element 811. The plating solution flows through the chamber with a distinct transverse velocity component (parallel to the plating face of the wafer) and exits the plating chamber through exit port 819 after it passes through the gap between the element 811 and the top shield 813, as shown by the arrows. In the depicted embodiment the exit port is located near the peripheral portion of the top shield 813 and at an azimuthal location opposing the entry port 817. This flow pattern can be achieved using a cross-flow manifold described in detail in the U.S. Pat. No. 8,795,480 by Mayer et al., titled "Control of Electrolyte Hydrodynamics for Efficient Mass Transfer Control during Electroplating" issued on Aug. 5, 2014, and in US patent Publication No. 2013/0313123 by Abraham et al., titled "Cross Flow Manifold for Electroplating Apparatus", published on Nov. 28, 2013, which are herein incorporated by reference in their entireties. In these embodiments the apparatus may include a flow shaping device positioned between the element and the wafer, where the flow-shaping device provides for a cross-flow substantially parallel to the surface of the wafer substrate. For example the flow shaping device may be an omega-shaped plate that directs the cross-flow towards an opening in the omega-shaped plate. Concurrently, ionic current travels from the bottom portion of the chamber through the channels of the element 811 in a direction that has a prominent impinging component perpendicular to the plating surface of the wafer. The plating solution may also be concurrently provided and removed to the bottom portion of the chamber near the anode in a separate electrolyte delivery loop.

A DC power supply (not shown) is electrically connected with the wafer 809 and the anode 805, and is configured to negatively bias the wafer 809 and to positively bias the anode 805. The apparatus further includes a controller 821, which includes program instructions for performing electroplating, and allows for modulation of current and/or potential provided to the elements of electroplating cell. The controller may include program instructions specifying the rotation rates of the wafer and timing of wafer acceleration and deceleration such that the selected azimuthal region of the wafer dwells in a shielded area for a different amount of time that an analogous area with the same radial position but different azimuthal position. The controller can also include program instructions specifying the rates of electrolyte delivery and electrolyte composition. Generally, the controller is electrically connected with the components of the plating apparatus, and can include program instructions or logic specifying any of the parameters of provided electroplating methods.

The electroplating apparatus may further include one or more additional components that may help tune the uniformity of electrodeposition. For example, in some embodiments the apparatus further includes a thieving cathode positioned near the periphery of the substrate and configured to divert plating current from the near-edge portion of the substrate. In some embodiments the apparatus may further include one or more azimuthally symmetrical dielectric shields on the path of the plating current to restrict the current in the shielded area. These optional components are not shown in the illustration of the apparatus to preserve clarity.

Correction of azimuthal non-uniformity with the use of azimuthally asymmetric shields provided herein can be accomplished using methods that are described in detail the U.S. Pat. No. 8,858,774 issued on Oct. 14, 2014 to Mayer et al., and titled "Electroplating Apparatus for Tailored Uniformity Profile", which is herein incorporated by reference in its entirety. The methods involve providing a wafer substrate into any electroplating apparatus described herein and electroplating the metal on the substrate while rotating the substrate relative to a shield such that a selected portion of the substrate at a selected azimuthal position dwells in a shielded area for a different amount of time than a second portion of the substrate having the same average arc length and the same average radial position and residing at a different angular azimuthal position. In some embodiments, this is accomplished by using a variable rotation method. In this method a selected azimuthal region of the wafer is rotated at a certain angular speed, R1, over a given area, for example a holed area of the element, and is then rotated at a different angular speed, R2, over another area, for example, a shielded area. That is, varying the rotation speed during any individual full rotation of the wafer is one way to adjust and obtain azimuthal variable amounts of time-averaged shielding to which the wafer is exposed. One embodiment is electroplating in any of the above described apparatuses, where the wafer speed is varied during each rotation, or alternatively, the speed may be varied during a single rotation or in some rotations and not others. Also, the wafer speed may be varied only while spinning in one direction of rotation (e.g. clockwise) and not the other direction (e.g. counterclockwise) (if bidirectional rotation is used) or it may be varied in both rotational directions.

Figure 9:
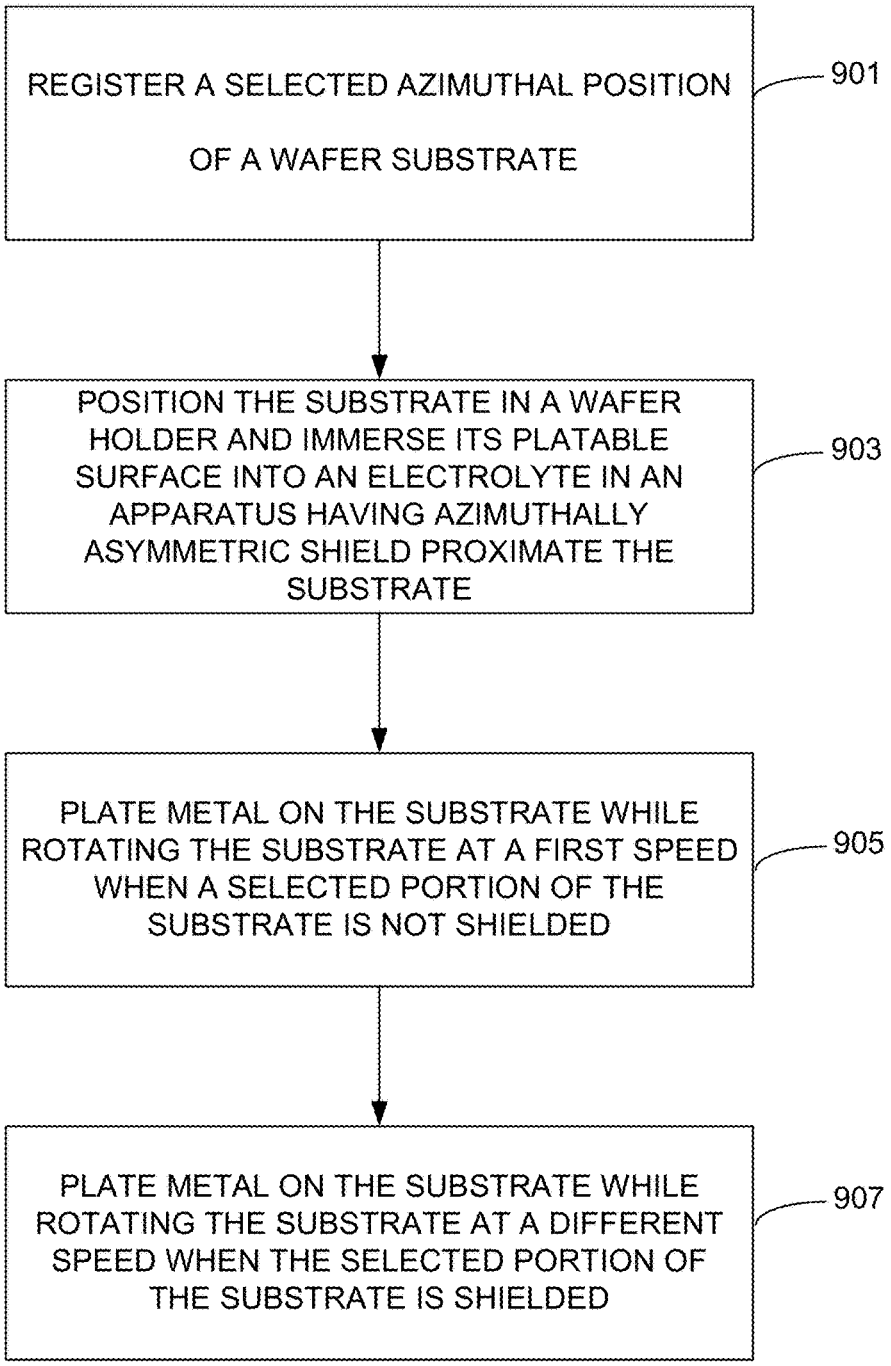
FIG. 9 is a process flow diagram for an electroplating method in accordance with one of the embodiments provided herein.

This process is illustrated by the process flow diagram shown in FIG. 9. The process starts in operation 901 by registering a selected azimuthal position on the wafer. For example azimuthal position of a notch or of a missing die region may be registered by an optical aligner and recorded in the memory. In operation 903, the substrate is provided into the substrate holder and is immersed into electrolyte. In operation 905 the substrate is being plated, while being rotated at a first speed when the selected portion of the substrate is not in the shielded area. In operation 907, the substrate is rotated at a different speed, when the selected portion of the substrate passes through the shielded area (i.e. over the top shield). The variable speed rotations can then be repeated as necessary. For example, one full rotation may include a period of rotation at 20 rpm or more followed by a period of rotation at 10 rpm or less, where plating includes at least 5 full variable-speed rotations. In one example, one full rotation of the wafer includes a period of rotation at about 40 rpm, when the selected portion of the wafer is not shielded, followed by a period of rotation at about 1 rpm while the selected portion of the wafer passes through the shielded area. Plating may include at least about 10, such as at least about 20 variable-speed rotations. It is understood that not necessarily all rotations in electroplating are variable speed. For example, the plating process can include both constant-speed full rotations and variable speed full rotations. Further, variable speed rotation can be implemented both during unidirectional and bidirectional rotation in the electroplating process.

In some embodiments, the substrate may slow down over a more shielded area two or more times per one full rotation of the substrate, such that two separate azimuthal portions on the wafer could dwell longer in the shielded area than analogous azimuthal portions (portions having the same average arc length and the same average radial position and residing at a different angular azimuthal position). In some embodiments two or more top azimuthally asymmetric shields can be used.

In some embodiments, more than two speeds may be employed. For example, one full rotation of the substrate may include rotation at a first speed, followed by slowing down to a second speed; rotation at a second speed followed by speeding up to a third speed; rotation at a third speed, followed by slow down to a fourth speed; rotation at a fourth speed, followed by speeding up to a first speed, wherein the first and third speed may be the same or different, and wherein the second and fourth speed may be the same or different. The periods of acceleration and deceleration may be very quick or, in some embodiments, relatively long. The dwell periods as well as acceleration and deceleration periods can be modulated in order to achieve improved uniformity. For example, different waveforms specifying one or more accelerations, decelerations, and dwell times, may be used in the form of program instructions in a controller electrically connected with the apparatus. In one example the controller can include program instructions for (a) rotating the substrate at a first rate for a first angular span; (b) decelerating the substrate from the first rate to a second rate for a second angular span; (c) rotating the substrate at the second rate for a third angular span; (d) accelerating the substrate back to the first rate for a fourth angular span, wherein (a)-(d) are carried out during one full rotation of the substrate (corresponding to 360 degree angular span). The angular span refers to an angle originating at the center of the wafer.

In another implementation, a similar effect on dwell time in a shielded area can be achieved using bidirectional rotation. Bidirectional rotation can be used such as to adjust a dwell time of a selected portion of the substrate at a selected azimuthal position in a shielded area, such that this dwell time is different from a dwell time of an analogous portion of a substrate at a different azimuthal position (having the same average arc length and same average radial position). For example, if the wafer is rotated clockwise and counterclockwise to a different degree, it will spend more time at certain azimuthal positions, relative to others. These positions may be selected such as to correspond to azimuthal positions that are shielded. For example, if the wafer is rotated clockwise by 360 degrees and counterclockwise by 90 degrees, it will spend more time in the sector between 270-360 degrees. Thus, in some embodiments the wafer is rotated bidirectionally, such that the selected azimuthal region of the substrate dwells more in the area shielded by the azimuthally asymmetric top shield.

EXPERIMENTAL EXAMPLES

Experiments A-D

The distribution of plating current and plated thickness was experimentally studied for four different configurations of shields. In all cases electroplating of copper was performed on blanket 300 mm semiconductor wafers that did not have an azimuthally asymmetric region. Therefore the efficiency of the shield and the geometry of the shielding was assessed by the decrease of plated thickness in the shielded area. In all cases the electroplating apparatus included an ionically resistive ionically permeable element having non-communicating channels, wherein the element had a flat wafer-facing surface, spaced apart from the platable surface of the wafer by 4.5 mm. In experiments B, C, and D the electroplating apparatus included an azimuthally asymmetric wedge-like shield positioned, above the element such that there was a 1.5 mm electrolyte-filled gap between the top surface of the element and the bottom surface of the shield. The gap allowed for flow of electrolyte in a direction that was parallel to the plating surface of the substrate. In the provided examples, the electrolyte flowed in the gap in an outward direction and exited the plating cell at the edge of the gap. The wafer was rotated at a rotation rate of 24 rpm and was slowed down to 1 rpm for an angular span of 10 degrees when a selected azimuthal position of the wafer was passing over an azimuthally asymmetric shield.

Experiment A (Comparative)

Figure 10A:
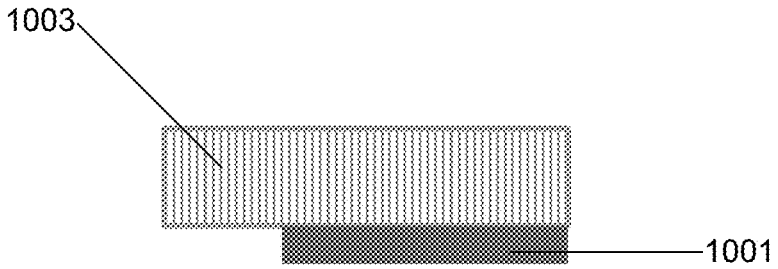
FIGS. 10A-10D are schematic cross sectional views illustrating relative positions of the top shield, the element, and the bottom shield, in the configurations that were used in experimental examples.

In a comparative experiment A the electroplating apparatus did not have any azimuthally asymmetric shields above the element, and contained only a wedge-like bottom shield blocking the channels of the element. The central angle of the bottom shield was 114 degrees and it was located at a height of 120 mm. This configuration is schematically illustrated by FIG. 10A, which shows a cross-sectional side view of a portion of the apparatus (right edge). The bottom shield 1001 is located directly below and in contact with the element 1003.

Experiment B

Figure 10B:
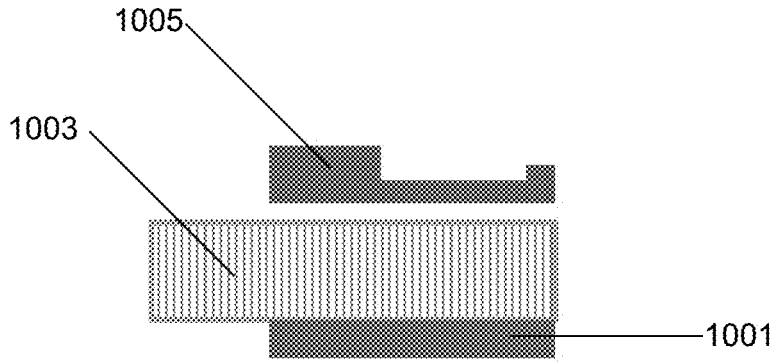

In the experiment B the electroplating apparatus contained the same wedge-like bottom shield as in the experiment A, but additionally included a top wedge-like shield that was coextensive with the bottom shield, where the top shield was positioned such that the distance from its flat wafer-facing surface of the shield to the wafer was 0.5 mm. The central angle of the top shield was 114 degrees and it was located at a height of 120 mm. This configuration is schematically illustrated by FIG. 10B, which shows a cross-sectional side view of a portion of the apparatus (right edge). The bottom shield 1001 is located directly below and in contact with the element 1003, while the top shield 1005 is located above the element and is coextensive with the bottom shield.

Experiment C

Figure 10C:
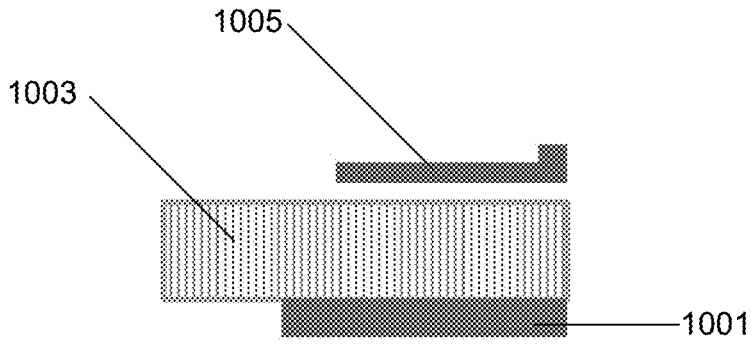

In experiment C the electroplating apparatus contained the same wedge-like bottom shield as in experiment A, but additionally included a top wedge-like shield that was smaller than the bottom shield. The top shield was also thinner than the top shield in the experiment B, and was positioned such that the distance from the wafer-facing surface of the shield to the wafer was 1.5 mm. The central angle of the top shield was 114 degrees and it was located at a height of 130 mm. Thus, in this configuration the bottom shield occupied not only the entire projection of the top shield, but also an additional area. This configuration is schematically illustrated by FIG. 10C, which shows a cross-sectional side view of a portion of the apparatus (right edge). The bottom shield 1001 is located directly below and in contact with the element 1003, while the top thin shield 1005 is located above the element.

Experiment D

Figure 10D:
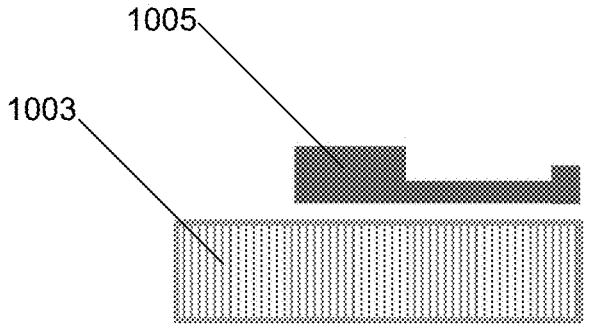

In experiment D the electroplating apparatus contained only the top shield and no bottom shield. The top shield was the same as in the experiment B, and was positioned such that the distance from the wafer-facing surface of the shield to the wafer was 0.5 mm. The central angle of the top shield was 114 degrees and it was located at a height of 120 mm. This configuration is schematically illustrated by FIG. 10D, which shows a cross-sectional side view of a portion of the apparatus (right edge). The top shield 1005 resides above the right edge of the element 1003.

Figure 11A:
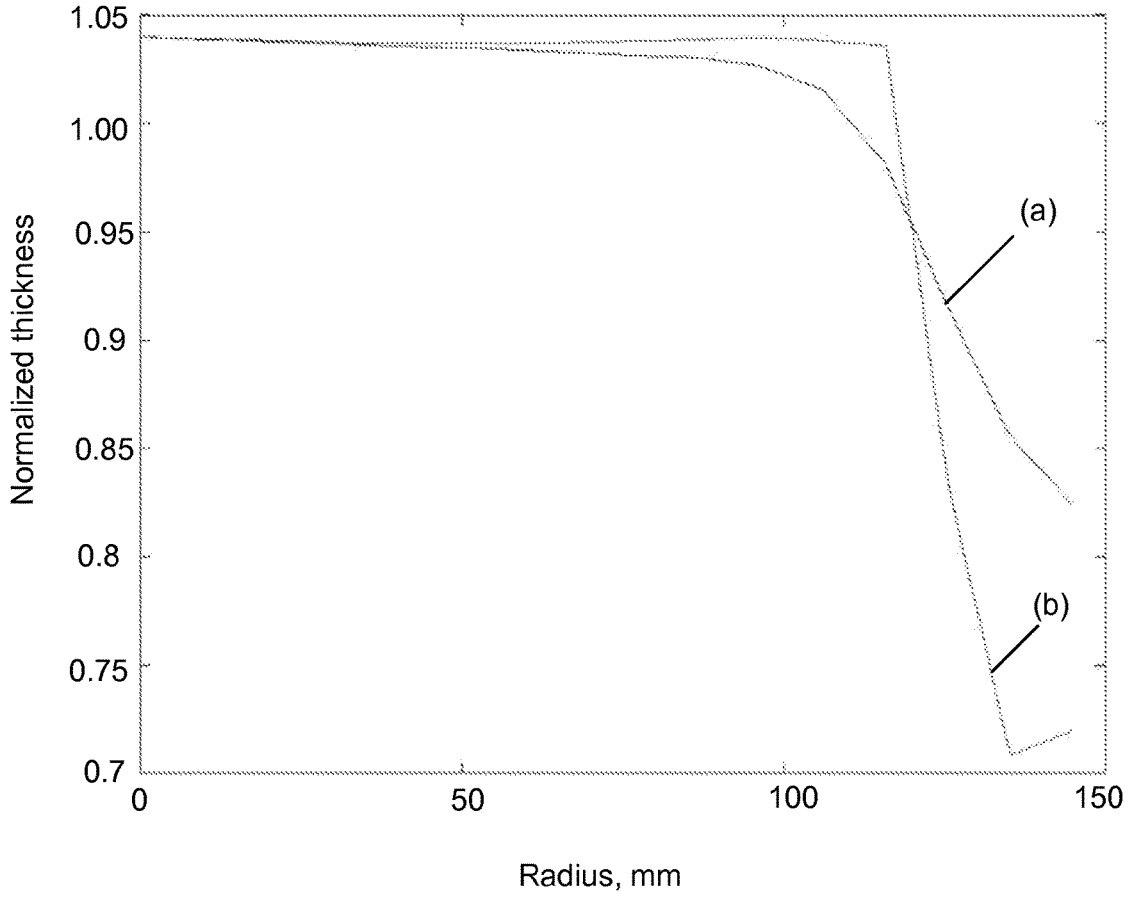
FIG. 11A is an experimental plot showing radial distribution of normalized plated thickness at a selected azimuthal position for experiments A and B.

FIG. 11A illustrates a plot comparing electroplated thickness distribution obtained in Experiment A (curve a) and in Experiment B (curve b). The plot shows normalized thickness as a function of wafer radius at the azimuthal position where shielding occurred. It can be seen that the plated thickness drops significantly more at the periphery of the wafer in the configuration B than in configuration A. It can also be seen that in configuration B the shield starts "working" more abruptly and at a greater distance from the center of the wafer than in configuration A.

Figure 11B:
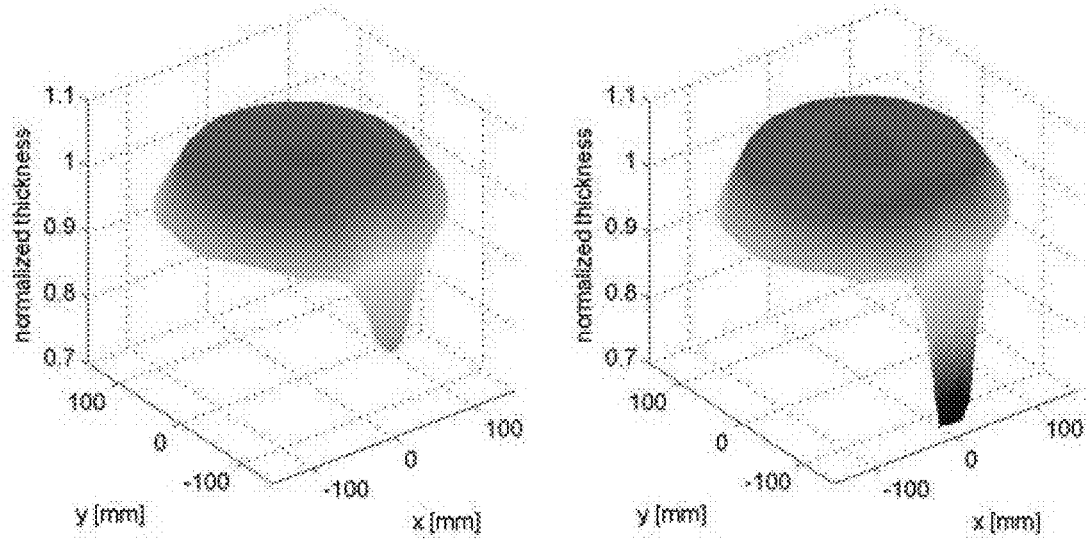
FIG. 11 B is an experimental plot showing 3-dimensional distribution of normalized plated thickness for experiments A and B.

FIG. 11B shows a three-dimensional plot of plated thickness on the wafer for Experiment A (plot a) and for Experiment B (plot b). It can be seen that the configuration with the top and bottom shields that is used in Experiment B is providing better shielding than the configuration with a bottom-only shield used in Experiment A.

Figure 11C:
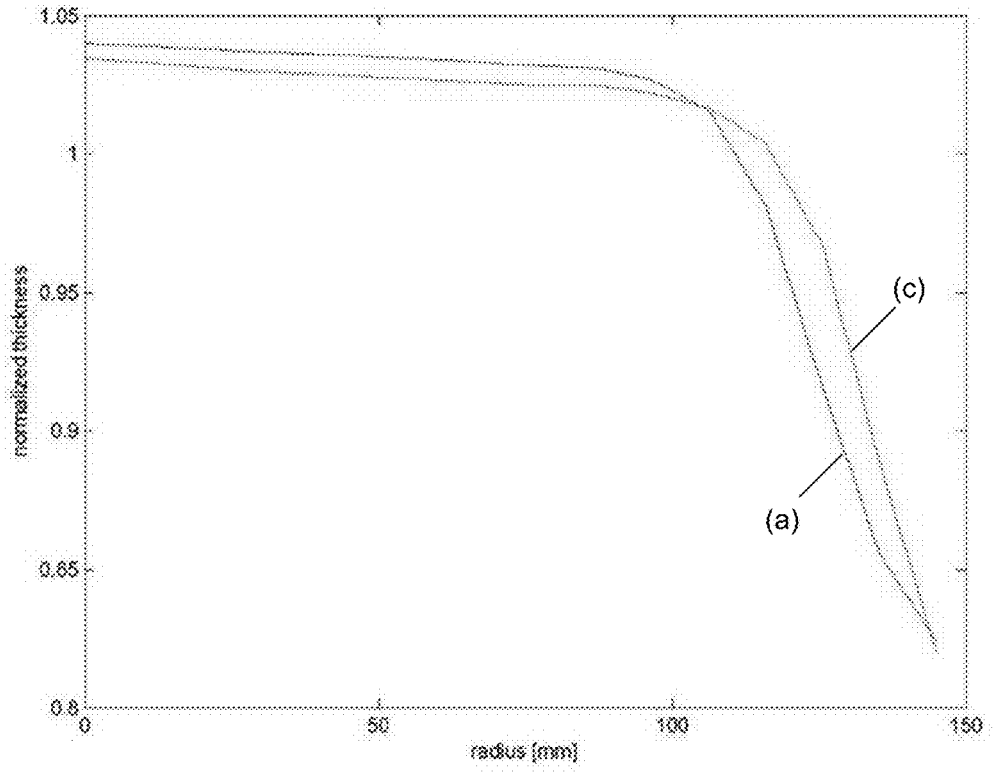
Figure 11D:
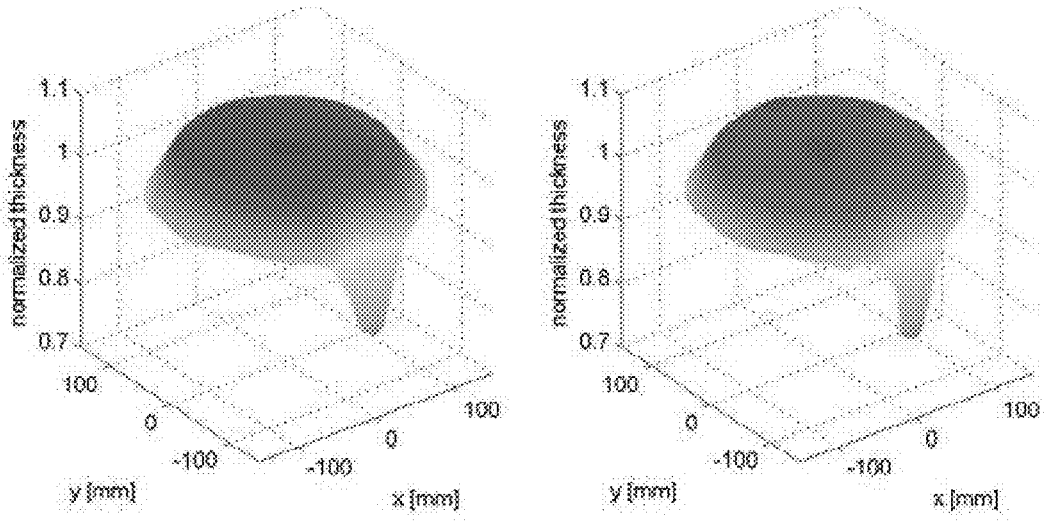

FIG. 11C illustrates a plot comparing electroplated thickness distribution obtained in Experiment A (curve a) and in Experiment C (curve c). It can be seen that both configurations have the same shielding at the very edge of the wafer, but the configuration used in Experiment C provides decreased shielding in the peripheral region (at a radial distance of about 110-140 mm) than the configuration used in Experiment A. FIG. 11D shows a three-dimensional plot of plated thickness on the wafer for Experiment A (plot a) and for Experiment C (plot c).

Figure 11E:
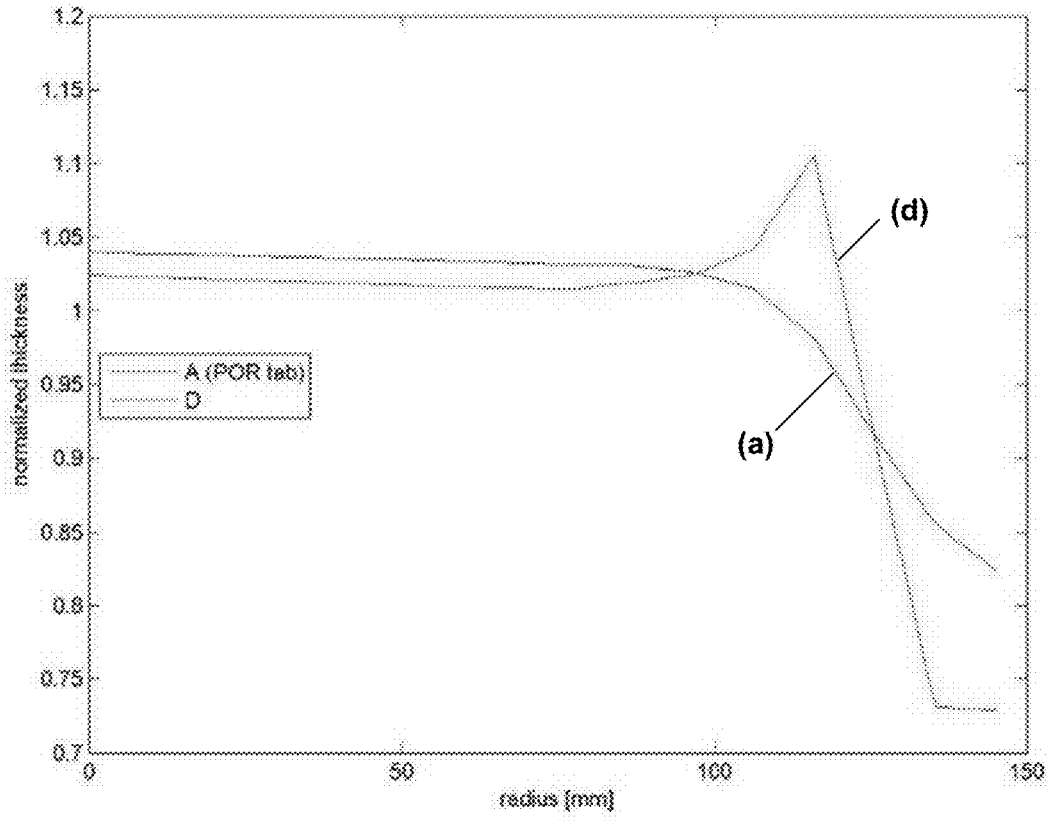
Figure 11F:
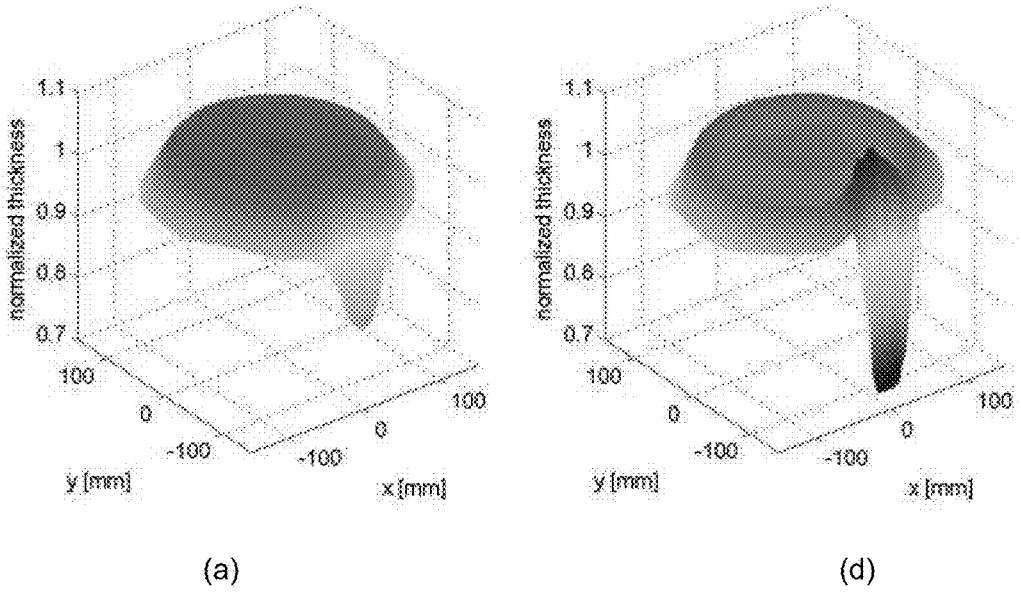

FIG. 11E illustrates a plot comparing electroplated thickness distribution obtained in Experiment A (curve a) and in Experiment D (curve d). It can be seen that configuration D provides better shielding at the edge of the wafer than configuration A, but also has a spike in thickness at a radial position of about 120 mm. This spike in thickness is due to the fact that in the absence of bottom shield the current can pass through the element and be directed to the periphery of the top shield thereby causing current crowding in this area. FIG. 11F shows a three-dimensional plot of plated thickness on the wafer for Experiment A (plot a) and for Experiment D (plot d).

Experiments E, F, and G. In these experiments the distribution of plated copper thickness was experimentally studied for three different configurations of shields on a patterned 300 mm wafer having a missing die region located at the edge (from 142 mm radial position to 150 mm radial position), and generally shaped as shown in FIG. 1. In all cases the electroplating apparatus included an ionically resistive ionically permeable element having non-communicating channels, wherein the element had a flat wafer-facing surface, spaced apart from the platable surface of the wafer by 4.5 mm. In comparative experiments E and F the electroplating apparatus had only the bottom azimuthally asymmetric shield below the element, as shown in FIG. 10A and there was no top shield. In experiment G, the electroplating apparatus had both a top shield and a bottom shield, as shown in configuration of FIG. 10 B, where both shields were wedge-shaped with a central angle of 160 degrees and were located at 130 mm radial position (referring to the vertex of the central angle of the wedge from the radial position of the center of the wafer). The gap between the top surface of the element and the bottom surface of the top shield was 0.5 mm.

In experiment E the wafer was rotated at a constant speed of 4 rpm and no correction of azimuthal uniformity was performed. In experiments F and G the wafer rotated at a speed of 24 rpm and was slowed down to 1 rpm for an angular span of 10 degrees when the missing die region was passing over the shielded area.

Figure 12:
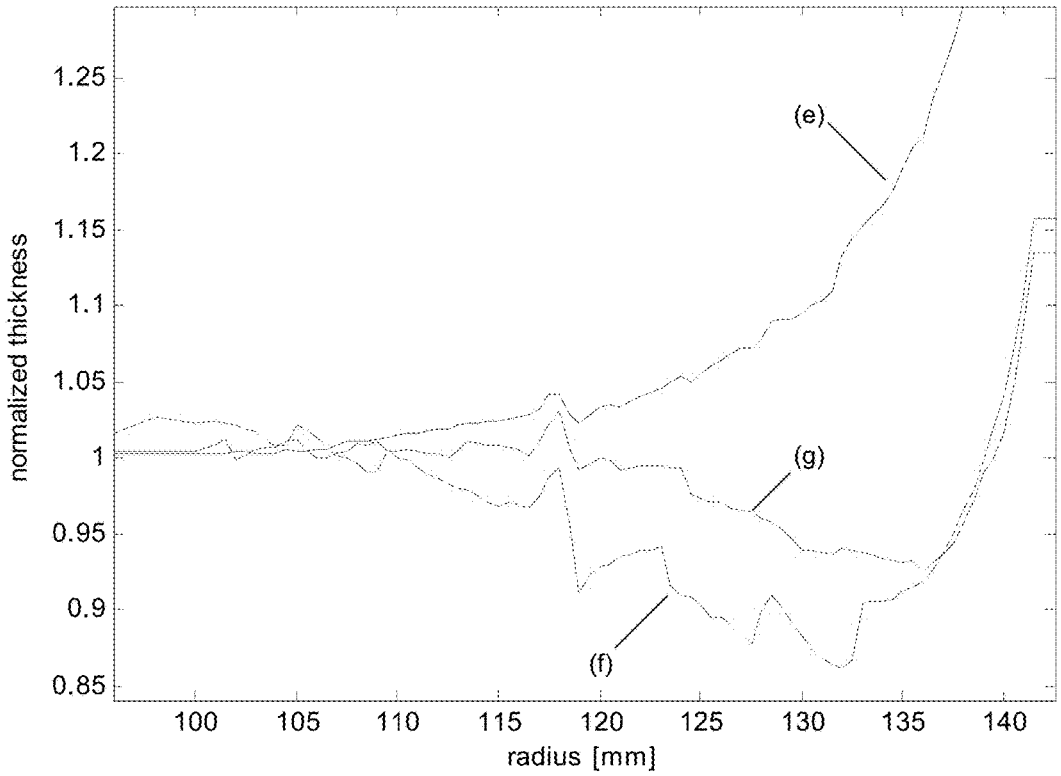
FIG. 12 is an experimental plot showing radial distribution of normalized plated thickness on a wafer having a missing die region at a selected azimuthal position for experiments E, F, and G.

FIG. 12 is a plot illustrating normalized plated thickness as a function of radial distance in the vicinity of the missing die region. The plated thickness obtained in experiments E, F, and G is illustrated by curves, e, f, and g respectively. It can be seen that the curve (e) obtained without any correction of azimuthal non-uniformity has the most pronounced increase in thickness near the missing die region due to current crowding, as expected. Curve (f), where the correction was performed with a bottom shield only, illustrates an improvement in uniformity, but it also has a region of lower-than-needed thickness due to overshielding in the 115-135 mm region. Curve (g) illustrates the advantages of using embodiments provided herein. When both the top and bottom shields are used, as provided herein, the overshielding in the 115-135 mm region is reduced and the uniformity is improved.

Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the parameters of delivery of power to primary anode, secondary electrode, and the substrate. Specifically, the controller may provide instructions for timing of application of power, level of power applied, etc.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

The apparatus/process described hereinabove may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility. Lithographic patterning of a film typically comprises some or all of the following steps, each step enabled with a number of possible tools: (1) application of photoresist on a workpiece, i.e., substrate, using a spin-on or spray-on tool; (2) curing of photoresist using a hot plate or furnace or UV curing tool; (3) exposing the photoresist to visible or UV or x-ray light with a tool such as a wafer stepper; (4) developing the resist so as to selectively remove resist and thereby pattern it using a tool such as a wet bench; (5) transferring the resist pattern into an underlying film or workpiece by using a dry or plasma-assisted etching tool; and (6) removing the resist using a tool such as an RF or microwave plasma resist stripper.

The invention claimed is:

1. An electroplating apparatus comprising:

(a) a plating chamber configured to contain an electrolyte and an anode while electroplating metal onto a semiconductor substrate;

(b) a substrate holder configured to hold the semiconductor substrate during electroplating;

(c) an ionically resistive ionically permeable element comprising a substrate-facing surface and an opposing surface, wherein the element allows for flow of ionic current through the element towards the semiconductor substrate during electroplating, wherein the ionically resistive ionically permeable element comprises a plurality of non-communicating channels, and wherein the ionically resistive ionically permeable element is positioned such that a closest distance between the substrate-facing surface of the element and a working surface of the semiconductor substrate is about 10 mm or less;

(d) a first shield, configured for providing azimuthally asymmetric shielding, wherein the shield has a substrate-facing surface and an opposing surface, wherein the first shield is positioned such that the closest distance between the substrate-facing surface of the first shield and the working surface of the substrate is less than about 2 mm and such that there is an electrolyte-filled gap between the substrate-facing surface of the ionically resistive ionically permeable element and the first shield during electroplating; and (e) a second shield positioned in contact with the opposing surface of the ionically resistive ionically permeable element, and blocking at least a portion of the non-communicating channels falling into a projection of the first shield such that ionic current flow through said portion of the non-communicating channels is blocked, wherein the electroplating apparatus is configured such that there is a microchamber between the semiconductor substrate and the ionically resistive ionically permeable element during electroplating, said microchamber having an inlet for introducing electrolyte flowing to the microchamber, and an outlet for receiving electrolyte flowing through the microchamber, wherein the inlet and the outlet are positioned proximate azimuthally opposing perimeter locations of the working surface of the semiconductor substrate, and wherein the inlet and outlet are adapted to generate cross-flow of electrolyte in the microchamber, including in the electrolyte-filled gap between the substrate-facing surface of the ionically resistive ionically permeable element and the first shield during electroplating.

2. The electroplating apparatus of claim 1, wherein the closest distance between the substrate-facing surface of the first shield and the working surface of the semiconductor substrate is about 0.5 mm-1.5 mm.

3. The electroplating apparatus of claim 1, wherein the substrate-facing surface of the first shield is contoured such that a distance from the substrate-facing surface of the first shield to the working surface of the semiconductor substrate is varied.

4. The electroplating apparatus of claim 1, wherein the substrate-facing surface of the first shield is contoured such that a distance from the substrate-facing surface of the first shield to the working surface of the semiconductor substrate is varied radially for a selected azimuthal position.

5. The electroplating apparatus of claim 1, wherein the substrate-facing surface of the first shield is contoured such that a distance from the substrate-facing surface of the first shield to the working surface of the semiconductor substrate at a first radial position is greater than at a second radial position, wherein the second radial position is greater than the first radial position.

6. The electroplating apparatus of claim 1, wherein the substrate-facing surface of the first shield is contoured such that a distance from the substrate-facing surface of the first shield to the working surface of the semiconductor substrate gradually decreases in a radial direction as the radial position increases at least for a portion of the first shield.

7. The electroplating apparatus of claim 1, wherein the first shield has one or more electrolyte-permeable openings.

8. The electroplating apparatus of claim 1, wherein the first shield is generally wedge-shaped.

9. The electroplating apparatus of claim 1, wherein the first shield is generally wedge-shaped and has a central wedge angle of between about 100-180°, located at a radial distance of between about 10-40 mm from a radial position of an edge of the substrate.

10. The electroplating apparatus of claim 1, wherein the ionically resistive ionically permeable element is positioned such that the distance between the substrate-facing surface of the ionically resistive ionically permeable element and the working surface of the semiconductor substrate is between about 2-10 mm during electroplating, and wherein the first shield is positioned such that the smallest distance between the substrate-facing surface of the first shield and the working surface of the semiconductor substrate is about 1.5 mm or less during electroplating.

11. The electroplating apparatus of claim 1, wherein the gap between the ionically resistive ionically permeable element and the first shield is between about 0.5-5 mm.

* * * * *